US008393372B2

(12) United States Patent
Yamauchi et al.

(10) Patent No.: US 8,393,372 B2
(45) Date of Patent: Mar. 12, 2013

(54) SHEET PROCESSING APPARATUS AND IMAGE FORMING SYSTEM

(75) Inventors: Manabu Yamauchi, Kashiwa (JP); Naoto Watanabe, Abiko (JP); Takayuki Fujii, Tokyo (JP); Shunsuke Nishimura, Tokyo (JP); Satoru Yamamoto, Abiko (JP); Yushi Oka, Abiko (JP); Toshiyuki Miyake, Abiko (JP); Takashi Yokoya, Kashiwa (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 163 days.

(21) Appl. No.: 12/797,205

(22) Filed: Jun. 9, 2010

(65) Prior Publication Data

US 2010/0314049 A1 Dec. 16, 2010

(30) Foreign Application Priority Data

Jun. 16, 2009 (JP) ..... 2009-143284
May 24, 2010 (JP) ..... 2010-117970

(51) Int. Cl.
*B65C 9/20* (2006.01)
*B29C 65/50* (2006.01)

(52) U.S. Cl. ..... 156/384; 156/387; 156/443

(58) Field of Classification Search ..... 156/384, 156/387, 441.5, 442, 442.1–442.3, 443, 446, 156/448, 449
See application file for complete search history.

(56) References Cited

U.S. PATENT DOCUMENTS

| | | | | |
|---|---|---|---|---|
| 5,466,328 | A | 11/1995 | Nagashima | |
| 6,769,675 | B2 * | 8/2004 | Vijuk | 270/39.06 |
| 7,021,616 | B2 | 4/2006 | Mizuta et al. | |
| 7,134,370 | B2 | 11/2006 | Murata et al. | |
| 7,331,573 | B2 | 2/2008 | Mizuta et al. | |
| 2007/0057446 | A1 | 3/2007 | Nishimura et al. | |
| 2008/0122156 | A1 | 5/2008 | Fujii et al. | |
| 2009/0103962 | A1 | 4/2009 | Fujii et al. | |

FOREIGN PATENT DOCUMENTS

JP 2001191667 7/2001

OTHER PUBLICATIONS

U.S. Appl. No. 12/744,170, filed May 21, 2010. Applicants: Naoto Watanabe, et al.
U.S. Appl. No. 12/829,734, filed Jul. 2, 2010. Applicants: Naoto Watanabe, et al.

* cited by examiner

*Primary Examiner* — Sing P Chan
(74) *Attorney, Agent, or Firm* — Fitzpatrick, Cella, Harper & Scinto

(57) ABSTRACT

The sheet processing apparatus includes a buffer roller to form a sheet bundle by overlapping a plurality of sheets while respectively displacing an end part of each sheet at one end of the conveying direction toward the conveying direction, a fold conveying path to fold the displaced and overlapped sheet bundle twice into three layers so that the end part at one end covers an end part at the other end and the end parts at the one end are respectively exposed, and a sealer to seal the sheet bundle by adhering the end part at the one end of the twice-folded sheet bundle to a surface of the sheet bundle with a seal. The sealer adheres all of the end parts at the one end and the surface of the sheet bundle with a seal having length longer than exposed length of the end parts at the one end.

10 Claims, 22 Drawing Sheets

FIG. 22A

| Yn | SEAL LENGTH |
|---|---|
| Y0 | 20.0mm |
| Y1 | 30.0mm |
| Y2(Ymax) | 40.0mm |

FIG. 22B

| MATERIAL SHAPE | GRAMMAGE | RESTRICTED NUMBER |
|---|---|---|
| PLAIN PAPER | 64—79g/m$^2$ | 10 PAPERS |
| | 80—105g/m$^2$ | 8 PAPERS |
| | 106—200g/m$^2$ | 6 PAPERS |
| COATED PAPER | 64—79g/m$^2$ | 8 PAPERS |
| | 80—105g/m$^2$ | 6 PAPERS |
| | 106—200g/m$^2$ | 4 PAPERS |
| TRANSPARENCY FILM | | SETTING NOT ALLOWED |
| TAB SHEET | | SETTING NOT ALLOWED |

SHEET PROCESSING APPARATUS AND IMAGE FORMING SYSTEM

BACKGROUND OF THE INVENTION

1. Field of the Invention

The present invention relates to a sheet processing apparatus capable of performing a folding process and a sealing process with an adhesive member against a sheet and an image forming system having the sheet processing apparatus.

2. Description of the Related Art

In the related art, there has been an invention regarding a low-cost delivery matter without using an envelope. For example, Japanese Patent Application Laid-Open 2001-191667 discloses the so-called letter-sealing apparatus to prepare a delivery matter without using an envelope by forming a front sheet of a postal matter into a rectangular shape, folding or looping the front sheet so as to contact an edge part of the front sheet to a surface of the front sheet, and adhering a seal thereto.

In the delivery matter of the related art, only the front sheet is adhered with the seal. Therefore, in a case of a delivery matter having a plurality of sheets overlapped, a sheet placed at the inside of the front sheet may be fallen out from either of both edge parts intersecting with the edge part of the front sheet where the seal is adhered. As disclosed in Japanese Patent Application Laid-Open 2001-191667 as well, a front sheet having a special shape with flaps at the both intersecting edge parts not having a rectangular shape is required in order to prevent the falling-out. Accordingly, there has been a problem that the cost is increased.

To address this issue, the present invention provides a sheet processing apparatus capable of performing a folding process and a sealing process with an adhesive member against a sheet so as to be capable of preventing an inner sheet from being fallen out without using a sheet of a special shape.

SUMMARY OF THE INVENTION

According to the present invention, there is provided a sheet processing apparatus including: a displacing portion which forms a sheet bundle by overlapping a plurality of sheets while respectively displacing an end part of each sheet at one end of the conveying direction toward the conveying direction; and a folding portion which folds the sheet bundle twice into three layers displaced and overlapped by the displacing portion so that the end part at the one end covers an end part at the other end and the end parts at the one end of the plurality of sheets are respectively exposed; a sealing portion which seals the sheet bundle by adhering all of the end parts at the one end of the twice-folded sheet bundle to a surface of the sheet bundle with an adhesive member.

According to the present invention, since a sheet bundle is sealed by adhering end parts of all sheets which includes the sheet bundle and a surface of the sheet bundle with an adhesive member, an inner sheet is prevented from being fallen out without using a sheet of a special shape.

Further features of the present invention will become apparent from the following description of exemplary embodiments with reference to the attached drawings.

BRIEF DESCRIPTION OF THE DRAWINGS

FIG. 22A is a table which illustrates an example of seal length and FIG. 22B is a table which illustrates an example of the restricted number corresponding to paper types.

DESCRIPTION OF THE EMBODIMENTS

In the following, exemplary embodiments of the present invention will be described in detail in an exemplified manner with reference to the drawings. Here, dimensions, materials, shapes and relative arrangement of structural components described in the following embodiments may be appropriately modified in accordance with apparatus configurations to which the present invention is applied and various conditions. Therefore, unless otherwise specified, the scope of the present invention is not to be limited thereto.

In the present embodiment, an image forming system having an image forming apparatus main body and a sheet processing apparatus will be described as being exemplified. Here, in the sheet processing apparatus, a finisher and a letter-sealing apparatus are separately connected to constitute a system of the sheet processing apparatus as an example.

(General Configuration of Image Forming System)

Figure 1:
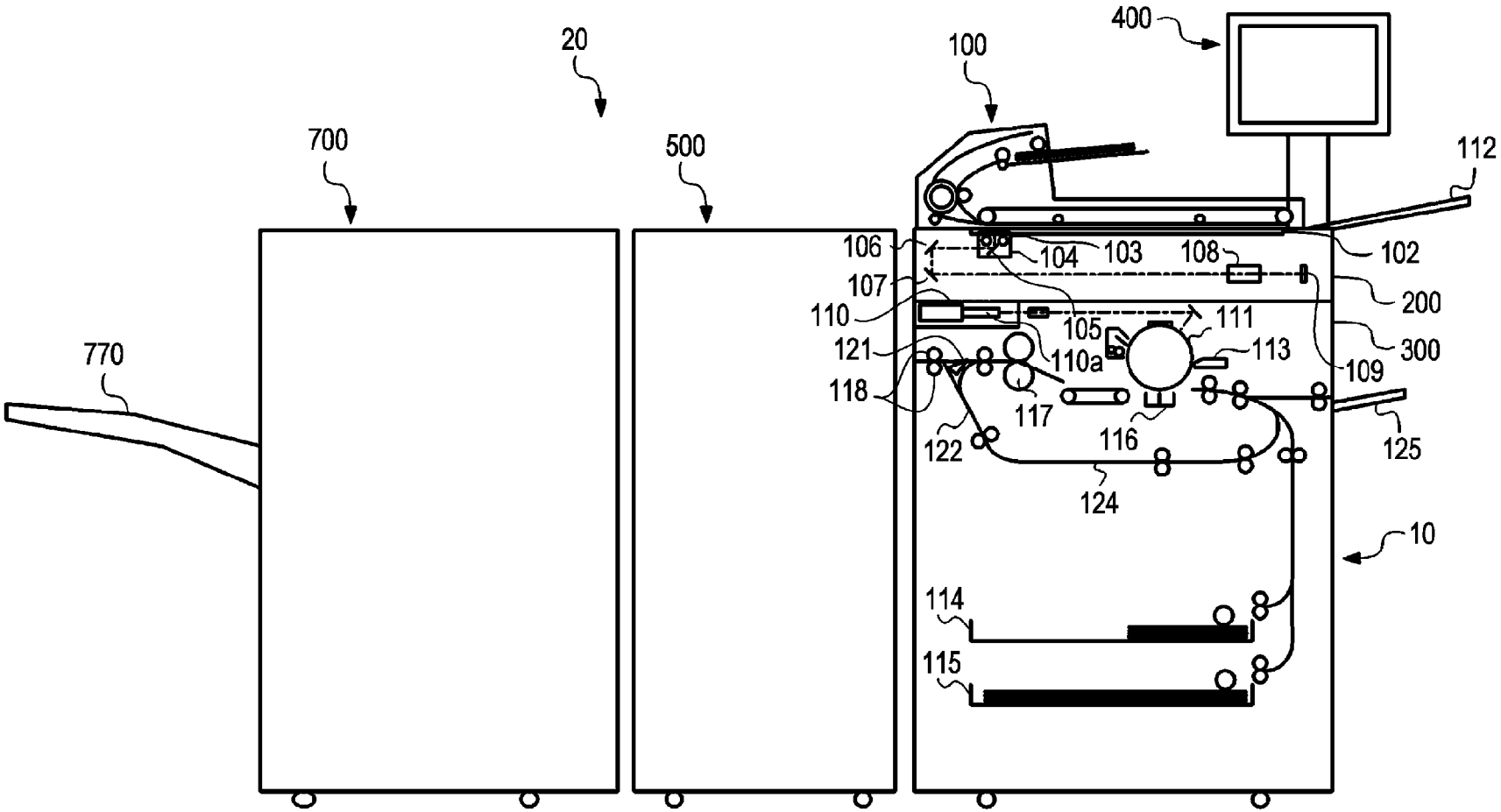
FIG. 1 is a general schematic view of an image forming system.

First, a general configuration of the image forming system is described with reference to FIG. 1. FIG. 1 is a general schematic view illustrating the configuration of a main part of the image forming system.

As illustrated in FIG. 1, the image forming system includes an image forming apparatus main body 10 and a sheet processing apparatus (a sheet processing portion) 20. The sheet processing apparatus 20 includes a finisher 500 and a letter-sealing apparatus 700. The image forming apparatus main body 10 includes an image reader 200 to read an image of an original and a printer 300 to record an image on a sheet.

An original feeding unit 100 is mounted on the image reader 200. The original feeding unit 100 feeds the originals which are set as being face-up on an original tray sequentially one by one from the top page and conveys to a reading position on a platen glass 102 via a curved path, and then, discharged toward an external discharge tray 112. An image of the original is read by a scanner unit 104 held at a position corresponding to the reading position when the original passes through the reading position on the platen glass 102. In general, this reading method is called original flow reading. Specifically, a reading face (an image face) of the original is irradiated with light of a lamp 103 of the scanner unit 104 when the original passes through the reading position, and then, the reflected light from the original is guided to a lens 108 via mirrors 105, 106, 107. The light passed through the lens 108 forms an image at an imaging face of an image sensor 109.

By conveying the original to pass through the reading position as described above, original reading scanning is performed having the direction perpendicular to the original conveying direction as a main scanning direction and the conveying direction as a sub-scanning direction. That is, reading of the entire original image is performed by conveying the original in the sub-scanning direction while the image sensor 109 reads the original image for each line in the main scanning direction when the original passes through the reading position. The image optically read as described above is output as being converted into image data by the image sensor 109. The image data output from the image sensor 109 is input to an exposure controlling portion 110 of a printer 300 as a video signal after a predetermined process is performed at a later-mentioned image signal controlling portion 202 (see FIG. 2).

By the way, the original image can be read by scanning in the sub-scanning direction with the scanner unit 104 in a state that the original is conveyed onto the platen glass 102 by the original feeding unit 100 and is stopped at a predetermined position. This reading method is called the so-called original fixed reading.

When reading an original without using the original feeding unit 100, first, the original is placed on the platen glass 102 after holding up the original feeding unit 100 by a user. Then, the reading of the original is performed by making the scanner unit 104 scan in the sub-scanning direction. That is, when reading the original image without using the original feeding unit 100, the original fixed reading is performed.

The exposure controlling portion 110 of the printer 300 modulates and outputs laser light based on the input video signal. The laser light is irradiated onto a photosensitive drum 111 which constitutes the image forming portion while being scanned by a polygon mirror 110*a*. An electrostatic latent image is formed at the photosensitive drum 111 in accordance with the scanned laser light. Here, as described later, the exposure controlling portion 110 outputs laser light so that a true image (not a mirror image) is formed when the original fixed reading is performed.

The electrostatic latent image on the photosensitive drum 111 is formed to be visualized as a developer image with developer supplied from the development device 113. Further, a sheet is fed from each cassette 114, 115, a manual feeding portion 125 or a duplex conveying path 124 at the timing synchronized with irradiation start of the laser light. The sheet is conveyed between the photosensitive drum 111 and a transfer portion 116. The developer image formed on the photosensitive drum 111 is transferred onto the fed sheet by the transfer portion 116.

The sheet having the developer image transferred is conveyed to a fixing portion 117. The fixing portion 117 fixes the developer image onto the sheet by applying heat and pressure to the sheet. The sheet passed through the fixing portion 117 is discharged from the printer 300 toward the outside (the finisher 500 and the letter-sealing apparatus 700) via a switching member 121 and a discharge roller 118.

Here, when the sheet is discharged in a state that the image-formed face thereof faced downward (face-down), the sheet passed through the fixing portion 117 is once guided into a reverse path 122 by switching operation of the switching member 121. After the rear end of the sheet passes through the switching member 121, the sheet is switched back and discharged from the printer 300 by the discharge roller 118. In the following, this discharge mode is called reverse discharge. The reverse discharge is performed when forming images sequentially from the top page, such as forming images read by using the original feeding unit 100 and forming images output from a computer. The discharged sheets are to be in ordinary sequence.

Meanwhile, when a hard sheet such as a transparency film is fed from the manual feeding portion 125 and an image is formed thereon, the sheet is discharged from the discharge roller 118 in a state that the image-formed face thereof faces upward (face-up) without being guided to the reverse path 122.

Further, in the case of setting duplex recording to perform image forming on both faces of the sheet, the sheet is conveyed to a duplex conveying path 124 after being guided to the reverse path 122 by the switching operation of the switching member 121. Then, the sheet guided to the duplex conveying path 124 is controlled to be fed once more between the photosensitive drum 111 and the transfer portion 116 at the abovementioned timing.

The sheet discharged from the printer 300 is fed to the finisher 500 and the letter-sealing apparatus 700 which include the sheet processing apparatus 20. The finisher 500 performs a displacing process, a binding process and a punch process. The letter-sealing apparatus 700 performs a twice-folding process and a letter-sealing process (a seal attaching process). The sheet or a sheet bundle as a final product having each process selectively performed is discharged and stacked on a stack tray 770 of the letter-sealing apparatus 700.

(Controller of Image Forming System)

Figure 2:
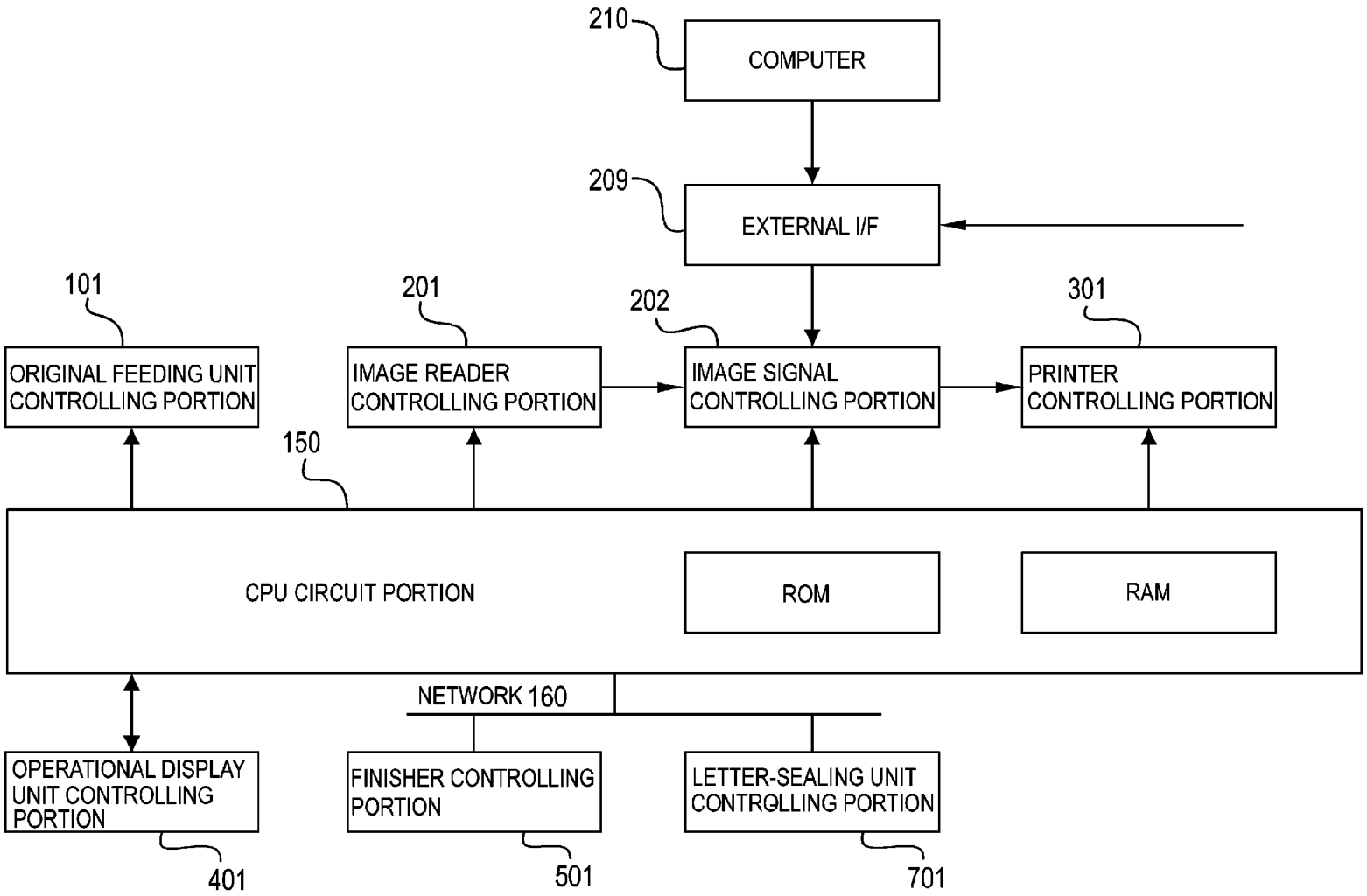
FIG. 2 is a block diagram of the entire image forming system.

Next, the configuration of a controller to perform control of the entire image forming system is described with reference to FIG. 2. FIG. 2 is a general block diagram illustrating a controller to control the entire image forming system in FIG. 1.

As illustrated in FIG. 2, the controller (the controlling portion) has a CPU circuit portion 150. The CPU circuit portion 150 is mounted on the image forming apparatus main body 10 and incorporates a CPU (not illustrated), a ROM 151 and a RAM 152. The CPU circuit portion 150 totally controls respective blocks 101, 201, 202, 301, 401, 501, 701 with a control program stored at the ROM 151. The RAM 152 temporarily stores control data and is utilized as a work area for arithmetic processes according to controlling.

The original feeding unit controlling portion 101 performs driving control of the original feeding unit 100 based on instructions from the CPU circuit portion 150. The image reader controlling portion 201 performs driving control against the above-mentioned scanner unit 104, the image sensor 109 and transfers an analog image signal output from the image sensor 109 to the image signal controlling portion 202.

The image signal controlling portion 202 performs various processes after converting the analog image signal from the image sensor 109 into a digital image signal, and then, converts the digital signal into a video signal and outputs the video signal to the printer controlling portion 301. Further, the image signal controlling portion 202 performs various processes on the digital signal input from a computer 210 via an external I/F 209, and then, converts the digital image signal into a video signal and outputs the video signal to the printer controlling portion 301. The processing operation by the image signal controlling portion 202 is controlled by the CPU circuit portion 150. The printer controlling portion 301 drives the abovementioned exposure controlling portion 110 based on the input video signal.

An operational display unit controlling portion 401 performs information communication between an operational display unit 400 (see FIG. 1) and the CPU circuit portion 150. The operational display unit 400 is mounted on the image forming apparatus main body 10 and includes a plurality of keys to set various functions regarding image forming and a display portion to display information indicating setting conditions. The operational display unit controlling portion 401 outputs a key signal corresponding to operation of each key to the CPU circuit portion 150 and displays corresponding information based on the signal from the CPU circuit portion 150 at the display portion. Here, the operational display unit 400 also functions as a setting portion to set the number of sheets for each sheet bundle.

A finisher controlling portion 501 is mounted on the finisher 500 and performs driving control of the entire finisher by performing information communication with the CPU circuit portion 150. The control details will be described later.

Similarly, a letter-sealing controlling portion 701 is mounted on the letter-sealing apparatus 700 and performs driving control of the entire letter-sealing apparatus by performing information communication with the CPU circuit portion 150. The control details will be described later as well.

(Finisher Controlling Portion)

Figure 13:
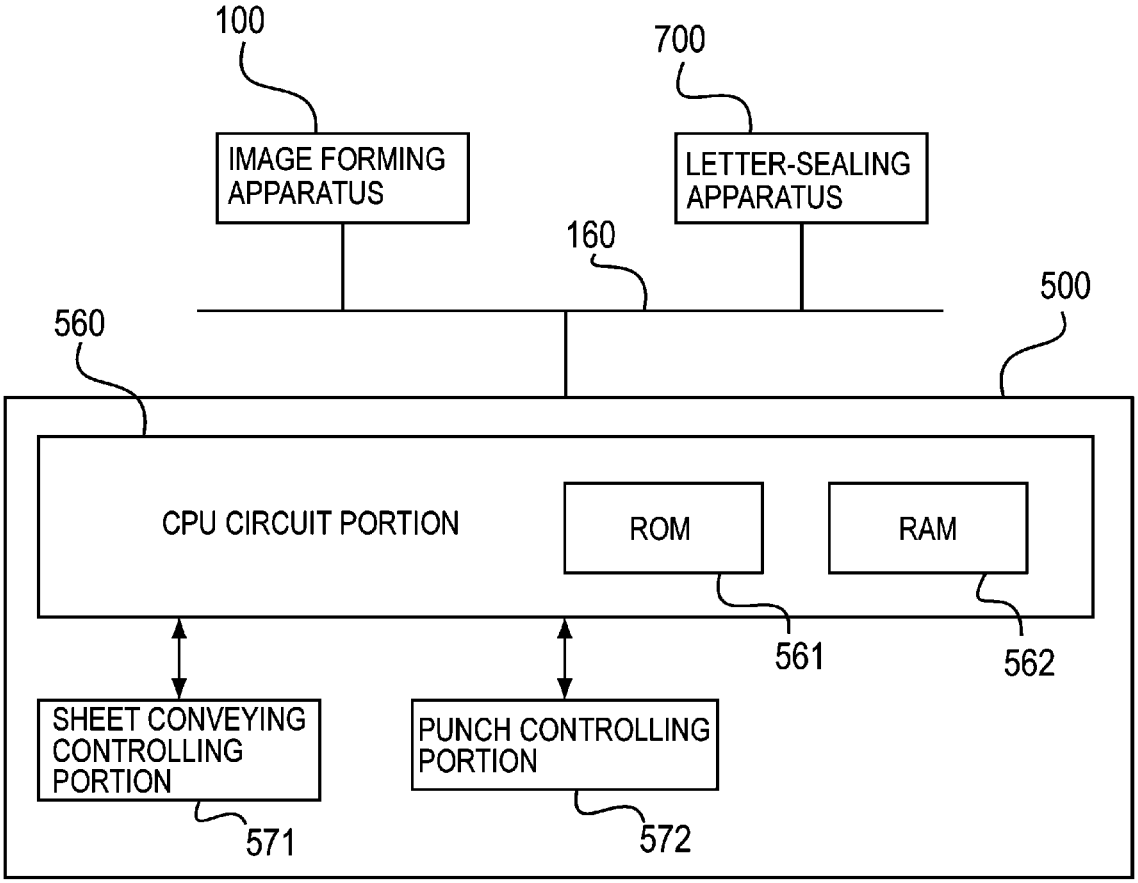
FIG. 13 is a block diagram of the finisher.

Next, the configuration of the finisher controlling portion 501 to perform driving control of the finisher 500 will be described with reference to FIG. 13. FIG. 13 is a block diagram illustrating the configuration of the controlling portion of the finisher 500 in FIG. 4.

As illustrated in FIG. 13, the finisher controlling portion 501 includes a CPU circuit portion 560, a ROM 561 and a RAM 562. The finisher controlling portion 501 performs data exchange by communicating with the CPU circuit portion 150 arranged at the image forming apparatus main body 10 and a CPU circuit portion 790 (see FIG. 14) arranged at the letter-sealing apparatus 700 via a communication IC (not illustrated) and a network 160. Then, the finisher controlling portion 501 performs driving control of the finisher 500 by executing various programs stored at the ROM 561 based on the instructions from the CPU circuit portion 150. The RAM 562 temporarily stores control data and is utilized as a work area for arithmetic processes according to controlling.

A sheet conveying controlling portion 571 communicates with the CPU circuit portion 560 and performs sheet conveying control with various rollers in the finisher 500. A punch controlling portion 572 communicates with the CPU circuit portion 560 and performs punch process control of a punch unit 550.

(Letter-Sealing Apparatus Controlling Portion)

Figure 14:
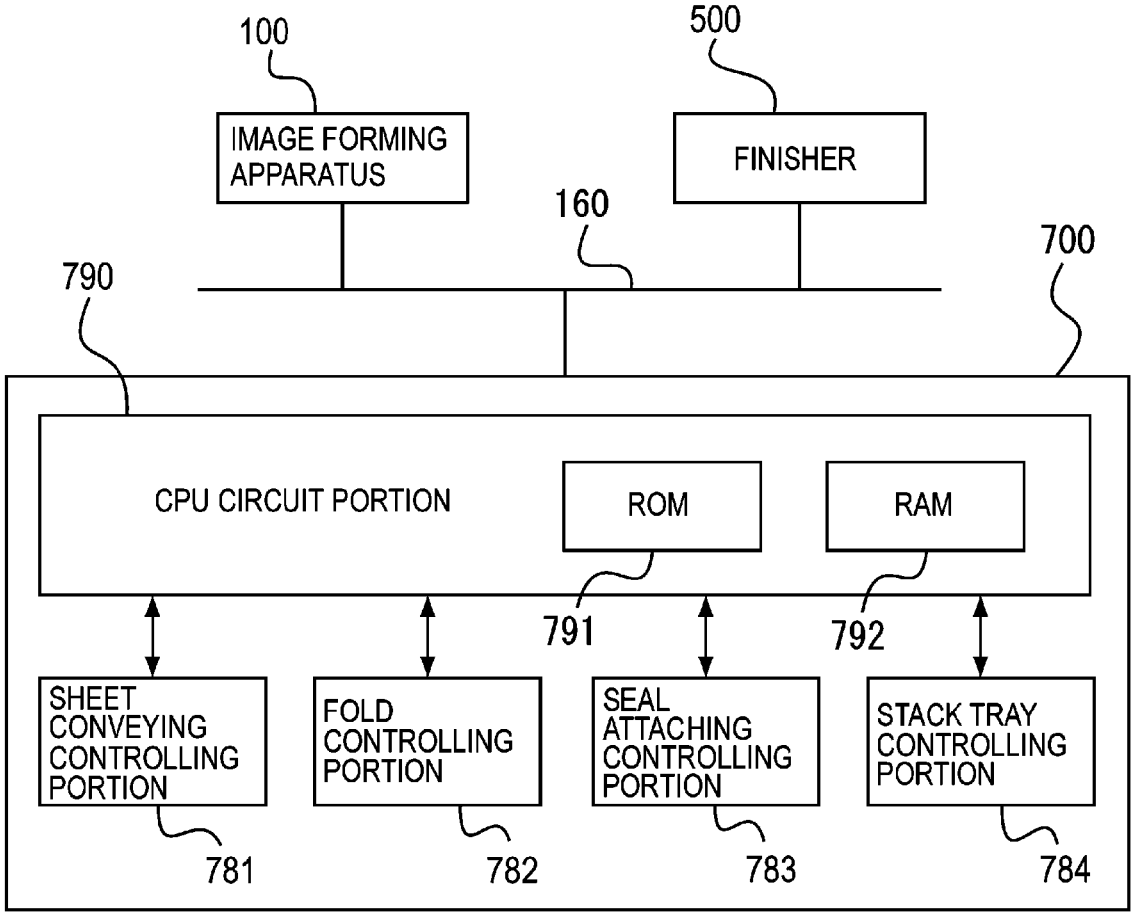
FIG. 14 is a block diagram of the letter-sealing apparatus.

Next, the configuration of the letter-sealing apparatus controlling portion 701 to perform driving control of the letter-sealing apparatus 700 will be described with reference to FIG. 14. FIG. 14 is a block diagram illustrating the configuration of the controlling portion of the letter-sealing apparatus 700 in FIG. 6.

As illustrated in FIG. 14, the letter-sealing apparatus controlling portion 701 includes the CPU circuit portion 790, a ROM 791 and a RAM 792. The letter-sealing apparatus controlling portion 701 performs data exchange by communicating with the CPU circuit portion 150 arranged at the image forming apparatus main body 10 and the CPU circuit portion 560 (see FIG. 13) arranged at the finisher 500 via a communication IC (not illustrated) and a network 160. Then, the letter-sealing apparatus controlling portion 701 performs driving control of the letter-sealing apparatus 700 by executing various programs stored at the ROM 791 based on the instructions from the CPU circuit portion 150. The RAM 792 temporarily stores control data and is utilized as a work area for arithmetic processes according to controlling.

A sheet conveying controlling portion 781 communicates with the CPU circuit portion 790 and performs sheet conveying control with various rollers in the letter-sealing apparatus 700. A fold controlling portion 782 communicates with the CPU circuit portion 790 and performs fold control of a sheet or a sheet bundle at a sheet fold conveying path. A seal attaching controlling portion 783 communicates with the CPU circuit portion 790 and performs letter-sealing process control of a sealer 760. A stack tray controlling portion 784 communicates with the CPU circuit portion 790 and performs lifting and lowering control of the stack tray 770.

(Operational Display Unit)

Figure 3A:
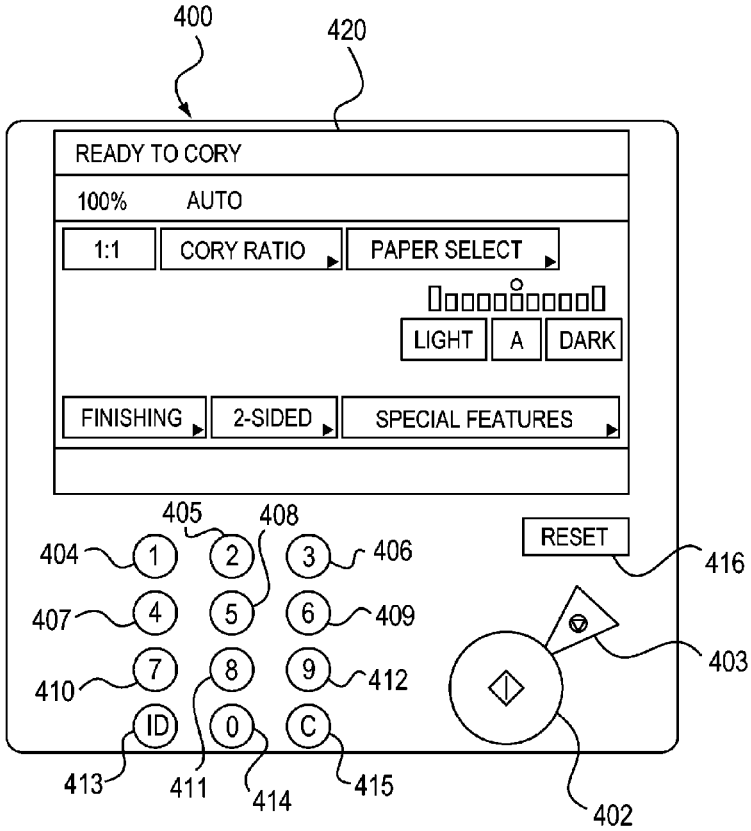
FIG. 3A is a plane view of an operational display unit and FIG. 3B is a plane view of an operational display portion (a paper type registration screen) of the operational display unit.

FIG. 3A is a plane view illustrating the operational display unit 400 of the image forming system in FIG. 1. As illustrated in FIG. 3A, various keys are arranged at the operational display unit 400. A start key 402 is to start image forming operation. A stop key 403 is to stop the image forming operation. A ten-key 404 to 412 and 414 is to perform number setting. Further, an ID key 413, a clear key 415 and a reset key 416 are arranged. A use-mode key 417 is to perform setting of various units. In addition, an operational display portion 420 having a touch panel is arranged at the upper part of the operational display unit 400 so as to be capable of preparing soft keys on a screen thereof.

Figure 18A:
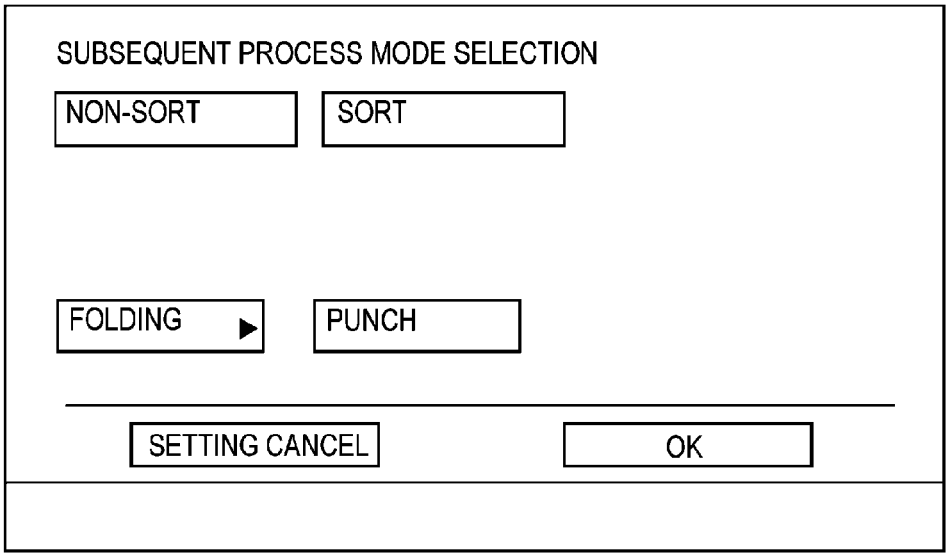
FIG. 18A is a plane view of the operational display portion (a process mode selection screen) of the operational display unit and FIG. 18B is a plane view of the operational display portion (a folding mode selection screen) of the operational display unit.

The image forming system includes process modes such as a non-sort mode, a sort mode, a punch mode, a folding mode, a letter-sealing mode. Setting of such a process mode is performed by inputting operation of the operational display unit 400 or a computer 210. For example, in the case of setting the process mode, when a soft key "Finishing" is selected at an initial screen illustrated in FIG. 3A, a menu selection screen illustrated in FIG. 18A is displayed at the operational display portion 420. Then, the process mode setting is performed by utilizing the menu selection screen.

Figure 3B:
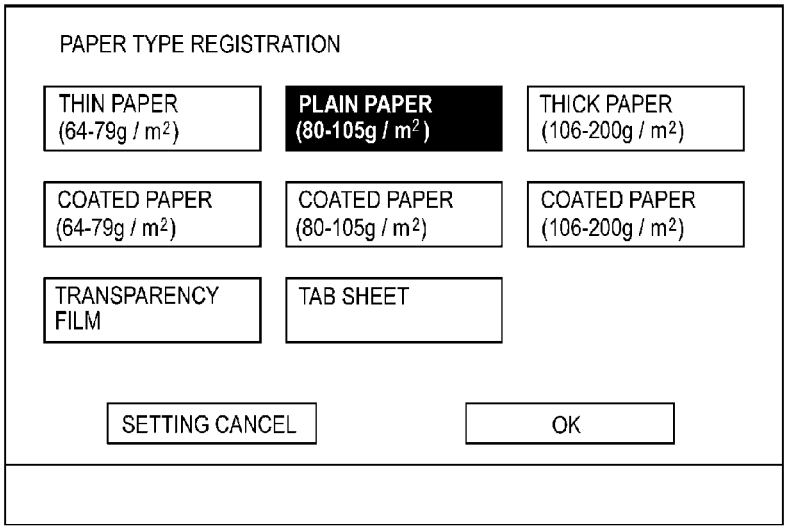

Further, when a soft key "Paper Select" is selected at the initial screen illustrated in FIG. 3A, a menu selection screen illustrated in FIG. 3B is displayed at the operational display portion 420. FIG. 3B is a plane view of the menu selection screen illustrating a registration screen of a paper type. By utilizing the menu selection screen (the operational display portion 420), the types of paper (the sheets) to be set at the cassettes 114, 115 and the manual feeding portion 125 can be set and registered. Accordingly, grammage, material and shape of the paper of the respective feeding portions 114, 115, 125 can be determined.

(Finisher)

Figure 4:
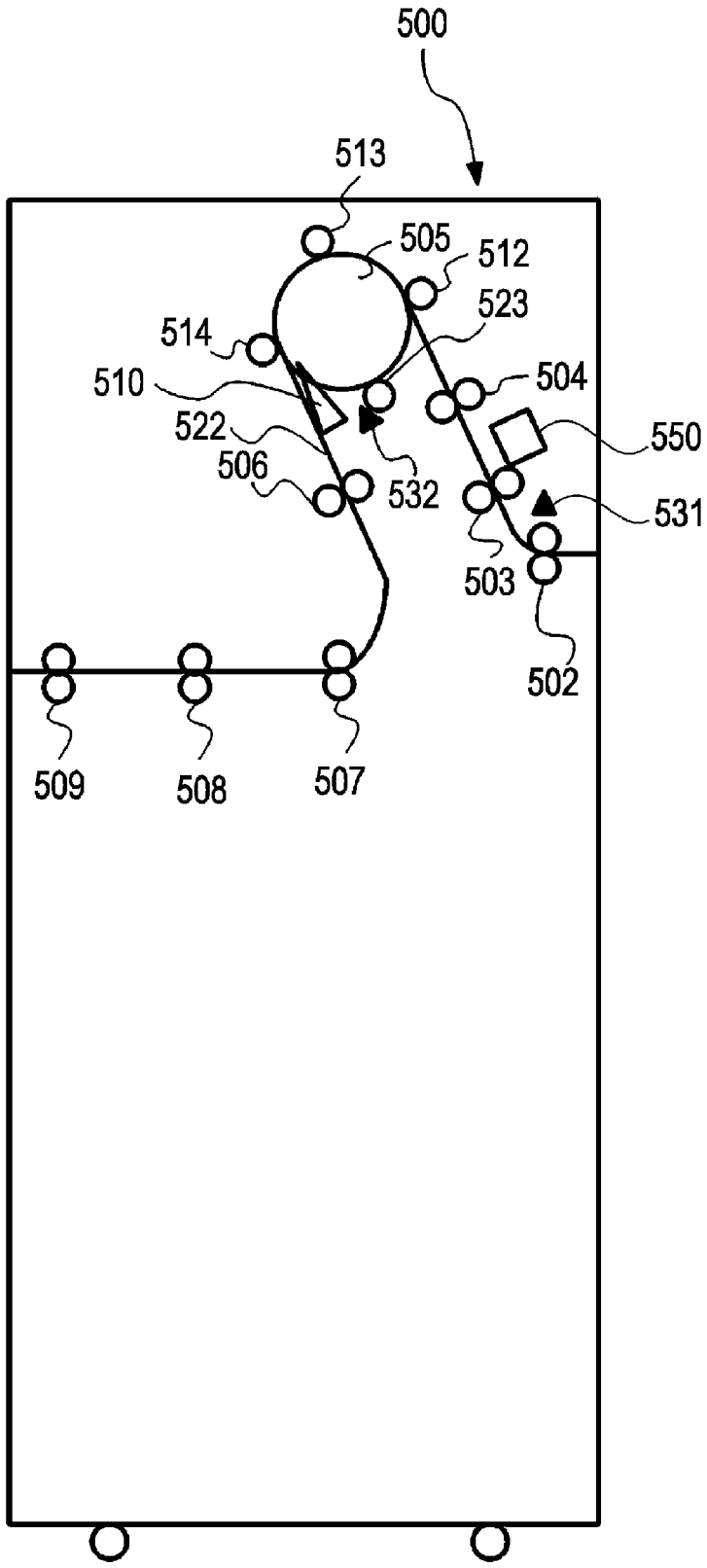
FIG. 4 is a sectional view of a finisher.
Figure 5A:
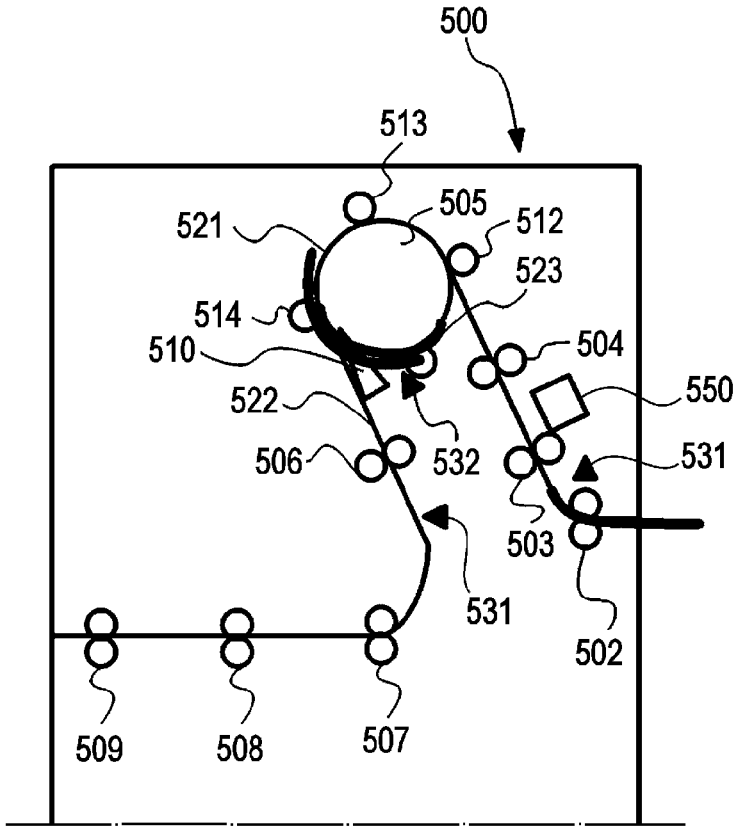
FIGS. 5A and 5B are partial sectional views which illustrate a displacing process of a sheet.
Figure 5B:
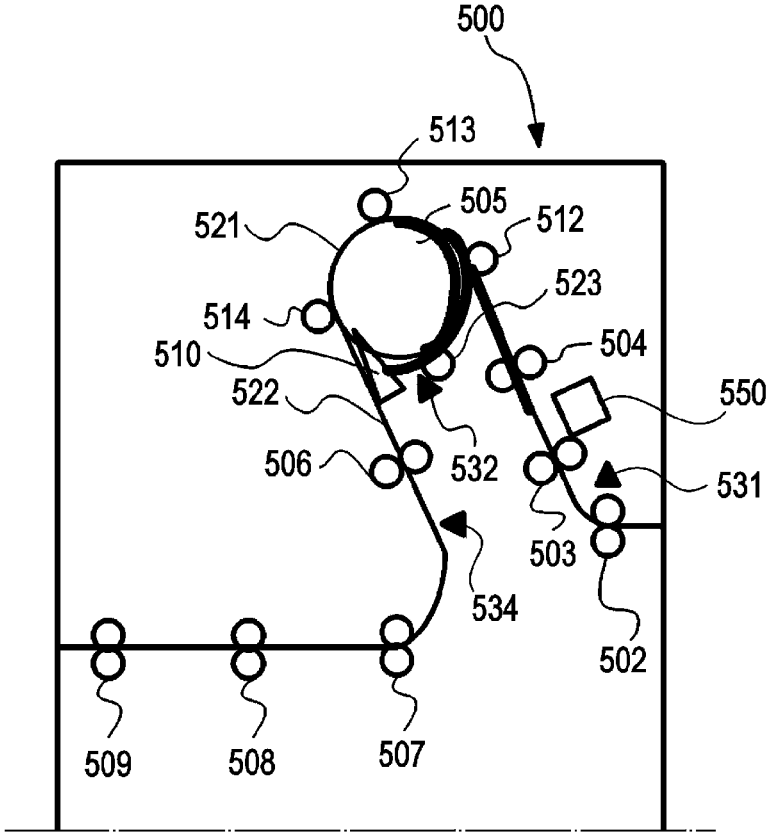

Next, the configuration of the finisher 500 is described with reference to FIGS. 4, 5A and 5B. FIG. 4 is a schematic view of the finisher 500 in FIG. 1.

The finisher 500 sequentially takes in the sheets discharged from the image forming apparatus main body 10 and selectively performs a following predetermined process. For example, as the predetermined process, there are a shift-sort process, a non-sort process, a sort process, a punch process to punch the taken sheets with a punch unit and a displacing process to stack a plurality of sheets while displacing the taken sheets in the conveying direction.

As illustrated in FIG. 4, the finisher 500 takes inside the sheet discharged from the image forming apparatus main body 10 by a pair of inlet rollers 502. The sheet taken inside by the pair of inlet rollers 502 is fed toward a buffer roller 505 via a pair of conveying rollers 503. An inlet sensor 531 is arranged at a midpoint of a conveying path between the pair of inlet rollers 502 and the pair of conveying rollers 503.

Further, a punch unit 550 as a punch portion is arranged at a midpoint of a conveying path between the pair of conveying rollers 503 and the buffer roller 505. The punch unit 550 once stops the sheet which is conveyed by the pair of conveying rollers 504 and performs a punch process on an end part of the sheet at one end in the conveying direction with a punch blade (not illustrated) incorporated by the punch unit 550.

Further, the buffer roller (a rotating member) 505 capable of being wound by the plurality of sheets conveyed via the pair of conveying rollers 504 is arranged downstream of the punch unit 550. Then, the sheets are wound by pushing rollers 512, 513, 514 during the buffer roller 505 is rotating and are conveyed in the rotating direction of the buffer roller 505.

A switching member 510 is arranged downstream of the pushing roller 514. The switching member 510 is to guide the sheet wound to the buffer roller 505 to a conveying path 522 while peeling from the buffer roller 505 or to guide the sheet to a buffer path 523 in a state of being wound to the buffer roller 505.

When the sheet wound to the buffer roller 505 is guided to the buffer path 523, the switching member 510 is not operated and the sheet is fed to the buffer path 523 in the state of being wound to the buffer roller 505. A buffer path sensor 532 to detect the sheet on the buffer path 523 is arranged at a midpoint of the buffer path 523.

In the following, description will be performed on a displacing portion to form a sheet bundle by stacking a plurality of sheets while displacing the end parts of the conveyed sheets at one end of the conveying direction toward the conveying direction. The displacing portion has the buffer roller (the rotating member) 505 capable of being wound by a plurality of conveyed sheets and the plurality of sheets are overlapped at the buffer roller 505 while being displaced in the rotating direction (the conveying direction) respectively by a predetermined amount. More specifically, the sheet guided onto the buffer path 523 is once stopped (see FIG. 5A) by stopping the rotation of the buffer roller 505. The sheet stop position is determined by an input pulse to a stepping motor which drives to rotate the buffer roller 505 having the buffer path sensor 532 as a reference. Then, the buffer roller 505 is started to rotate after a predetermined time from when the next sheet discharged from the image forming apparatus main body 10 is detected by the inlet sensor 531, so that the sheet stopped at the buffer path 523 is conveyed once again. Accordingly, the sheet on the buffer path 523 and the sheet discharged from the image forming apparatus main body 10 can be overlapped (see FIG. 5B). At that time, by changing the sheet stop position on the buffer path 523, a displacing sheet bundle can be prepared with the overlapped sheets respectively. That is, the sheet bundle having a plurality of sheets overlapped can be prepared while displacing the end part of the conveyed sheets at one end of the conveying direction toward the conveying direction by a predetermined amount. Here, in the description of the present embodiment, the sheet bundle is prepared by overlapping the plurality of sheets while displacing by the predetermined amount. However, the displaced amount for each sheet is not necessarily the same. For example, since returning force occurs after the fold process due to high stiffness thereof, large adhering force is required. In a case that a thicker sheet than other sheets is used for a front sheet of a later-mentioned sealed letter, the displaced amount thereof may be larger than that of other sheets in order to obtain excellent adhesiveness. Further, provided that one end part of a sheet at the most outer side and a surface of the folded sheet bundle are reliably adhered, an excellent product can be obtained as a sealed-letter. Therefore, the displaced amount as the sheet being toward the outside can be increased.

When the sheet wound around the buffer roller 505 or the sheet bundle is guided to the conveying path 522, the switching member 510 is operated and the sheet or the sheet bundle is peeled from the buffer roller 505 and guided to the conveying path 522.

The sheet or the sheet bundle guided to the conveying path 522 is discharged toward the outside via pairs of conveying rollers 506, 507, 508, 509.

(Letter-Sealing Apparatus)

Figure 6:
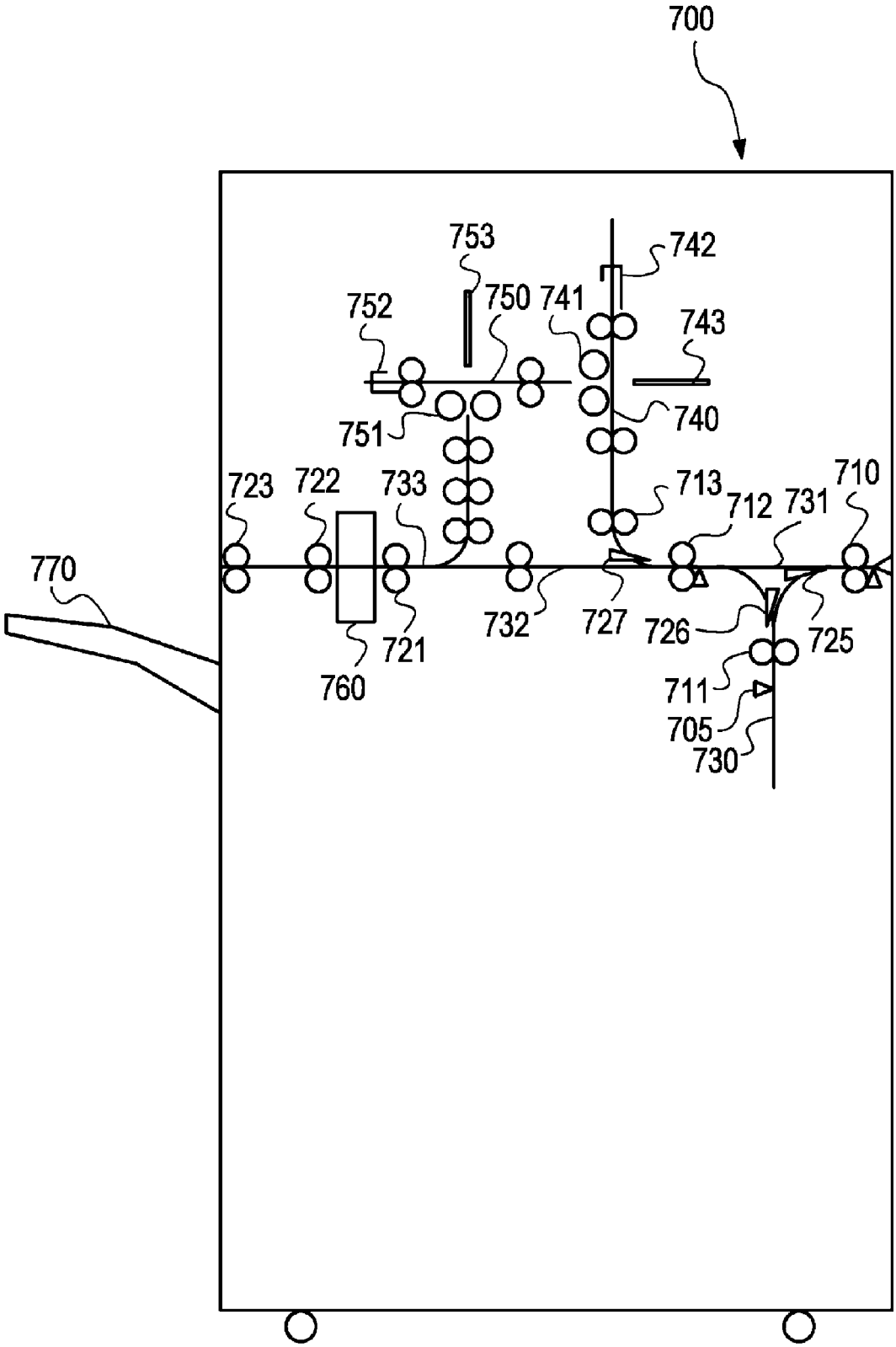
FIG. 6 is a sectional view of a letter-sealing apparatus.

Next the configuration of the letter-sealing apparatus 700 will be described with reference to FIGS. 6 to 9. FIG. 6 is the schematic view of the letter-sealing apparatus 700 in FIG. 1.

The letter-sealing apparatus 700 selectively performs, on the sheet or the sheet bundle, a reversing process to reverse faces thereof, a folding process such as an inwardly twice-folding process and an outwardly twice-folding process, and a letter-sealing process to prepare a simplified sealed letter by putting a seal at a sheet end part after the inwardly twice-folding process.

Here, the inwardly twice-folding process is a process to fold a sheet into three layers having valley-folding at two positions so that one face of the sheet is to be inside and one end part in the conveying direction covers the other end part. Meanwhile, the outwardly twice-folding process is a process to perform valley-folding and peak-folding respectively so that one face of a sheet is to be inside and outside.

The letter-sealing apparatus 700 illustrated in FIG. 6 takes the sheet discharged from the finisher 500 into the inside of the letter-sealing apparatus 700 by a pair of inlet rollers 710. The sheet taken inside by the pair of inlet rollers 710 is guided to a conveying path 731 or a reverse path 730 by a switching member 725. In a case that folding sequence is required to be changed depending on the process mode, the reversing process is performed. The conditions for the process mode of conveying to the reverse path 730 will be described later.

When the reversing process is performed, the switching member 725 is opened and the sheet is guided to the reverse path 730. After the sheet guided to the reverse path 730 is conveyed by a predetermined distance from where the sheet top end passes through the path sensor 705, a pair of rollers 711 is stopped and the sheet conveying is stopped. Then, by rotating the pair of rollers 711 in the reverse direction while opening the switching member 726, the sheet is reversed and fed to a pair of rollers 712.

Meanwhile, when the reversing process is not performed, the sheet is guided to the conveying path 731 and fed to the pair of rollers 712 by being conveyed while the switching member 725 is kept closed.

The sheet conveyed by the pair of rollers 712 is guided to the conveying path 732 or a fold conveying path 740 by a switching member 727. In the case that the folding process such as inwardly twice-folding and outwardly twice-folding is not performed against the sheet, the sheet is guided to a conveying path 732 and a conveying path 733 by being conveyed while the switching member 727 is kept closed.

Meanwhile, in the case that the folding process such as inwardly twice-folding and outwardly twice-folding is performed against the sheet, the sheet is guided to the fold conveying path 740 which includes a folding portion while opening the switching member 727. The fold conveying path 740 includes a folding roller 741, a top end restricting plate 742 and a pushing plate 743 and performs the first folding process against the sheet. The top end restricting plate 742 is moved by a stepping motor which is not illustrated. The position of the top end restricting plate 742 is controlled by an input pulse to the stepping motor.

In the case that inwardly twice-folding is performed, the top end restricting plate 742 is kept waiting at the position of one third of the sheet conveying direction length (hereinafter, called the sheet length) to the upper side than the fold center (the position of the pushing plate 743) in FIG. 6. In the case that the outwardly twice-folding is performed, the top end restricting plate 742 is kept waiting at the position of two third of the sheet length to the upper side than the fold center (the position of the pushing plate 743) in FIG. 6.

The pushing plate 743 is driven to the left side in FIG. 6 by a motor which is not illustrated. The pushing plate 743 functions to feed the sheet conveyed to the fold conveying path 740 to the folding roller 741. The folding roller 741 nips the sheet fed by the pushing plate 743 and performs the first folding process.

Figure 7A:
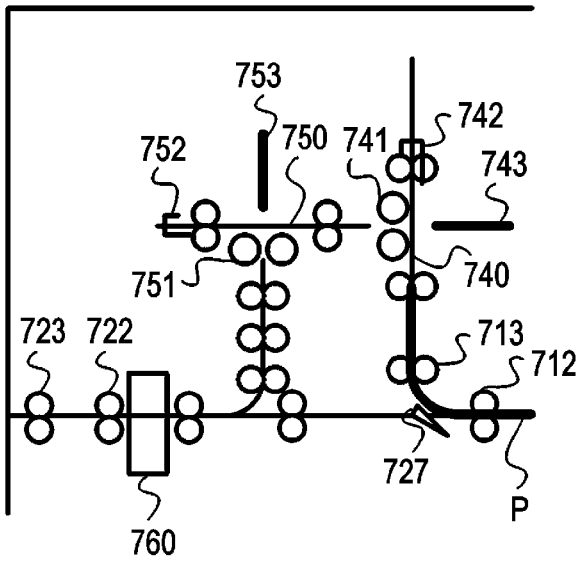
FIGS. 7A to 7C are partial sectional views which illustrate fold conveying.
Figure 7B:
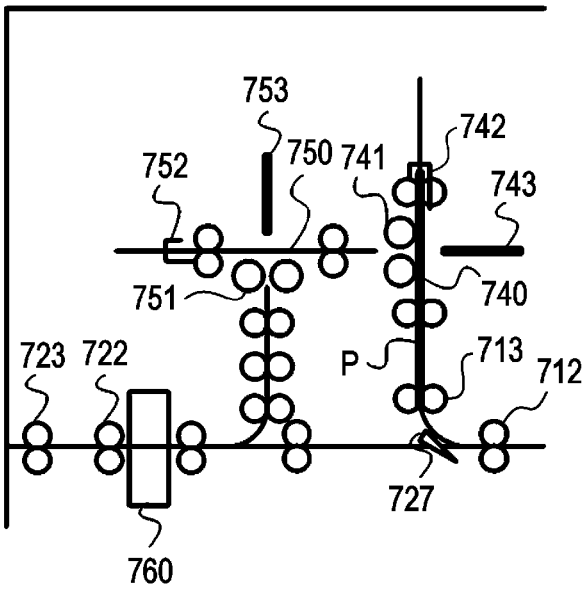
Figure 7C:
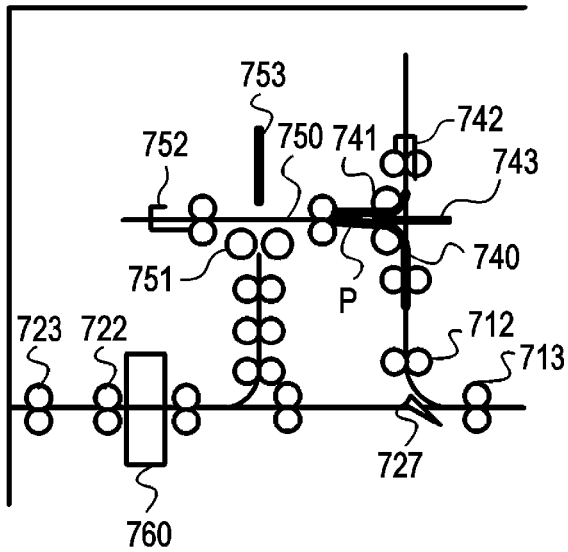

Here, fold conveying will be described having inwardly twice-folding as an example. The sheet P guided to the fold conveying path 740 by the switching member 727 as illustrated in FIG. 7A is conveyed until the top end thereof hits the top end restricting plate 742 as illustrated in FIG. 7B. After hitting the top end restricting plate 742, the sheet P is fed to the folding roller 741 as illustrated in FIG. 7C by driving the pushing plate 743. The sheet P fed to the folding roller 741 is fed to a fold conveying path 750 which includes the folding portion as being folded at the position of one third of the sheet length in a state that one third part of the sheet at the top end is folded.

Similar to the fold conveying path 740, the fold conveying path 750 includes a folding roller 751, a top end restricting plate 752 and a pushing plate 753 and performs the second folding process against the sheet. In both cases of the inwardly twice-folding and the outwardly twice-folding, the top end restricting plate 752 is kept waiting at the position of one third of the sheet length to the left side from the fold center (the position of the pushing plate 753) in FIG. 6.

Figure 8A:
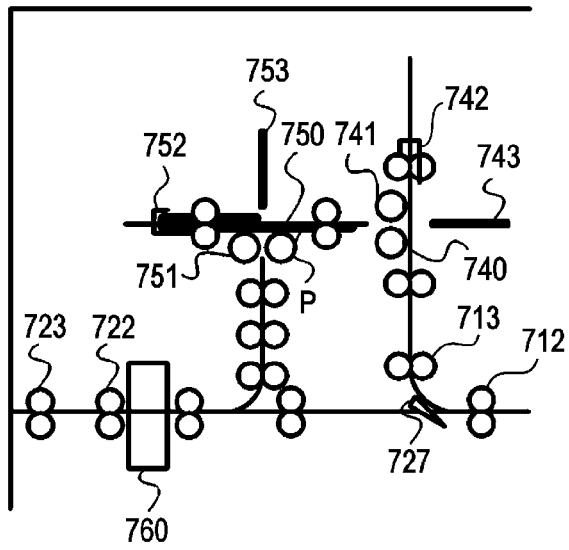
FIGS. 8A to 8C are partial sectional views which illustrate fold conveying.
Figure 8B:
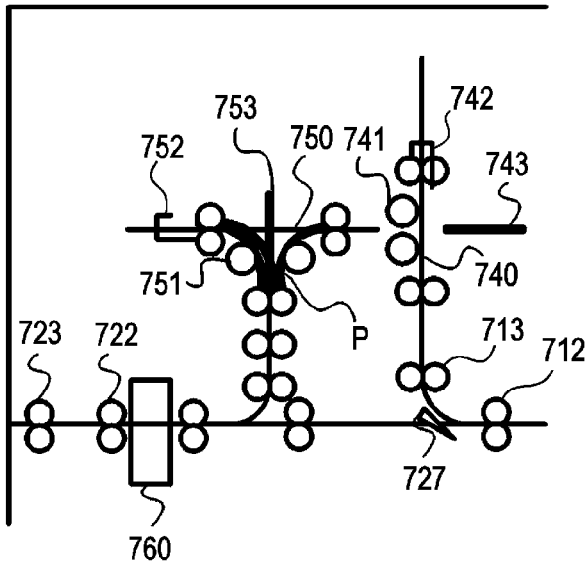
Figure 8C:
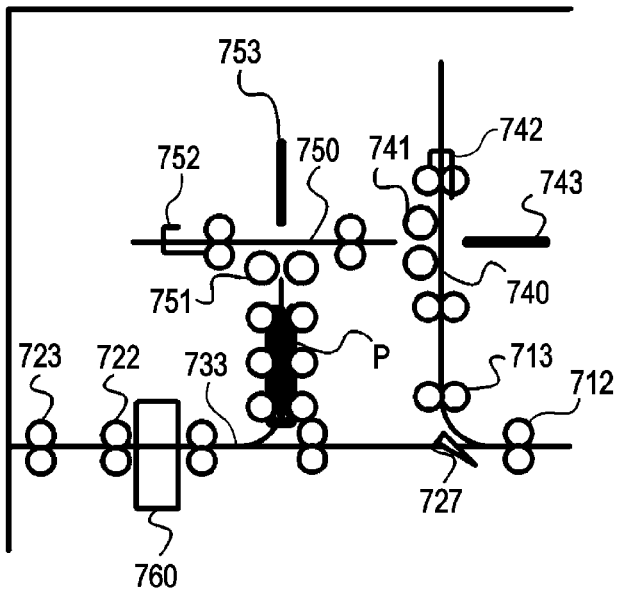

As illustrated in FIG. 8A, the sheet P guided to the fold conveying path 750 is conveyed until hitting the top end restricting plate 752. After hitting the top end restricting plate 752, the sheet P is fed to the folding roller 751 as illustrated in FIG. 8B by driving the pushing plate 753. As illustrated in FIG. 8C, the sheet P fed to the folding roller 751 is fed to the conveying path 733 in a state of being inwardly twice-folded so that one end part thereof in the conveying direction covers the other end part.

Here, as described above, the folding process against the sheet is performed by utilizing the folding roller and the pushing plate. However, the configuration to perform the folding process against the sheet is not limited to the above. For example, the sheet may be sequentially folded by generating a loop as hitting the sheet to the top end restricting plate and feeding the generated loop to a pair of rollers.

When the letter-sealing process is not performed, the sheet P fed into the conveying path 733 is discharged to the outside by the pairs of rollers 722, 723 and stacked on the stack tray 770.

Figure 9A:
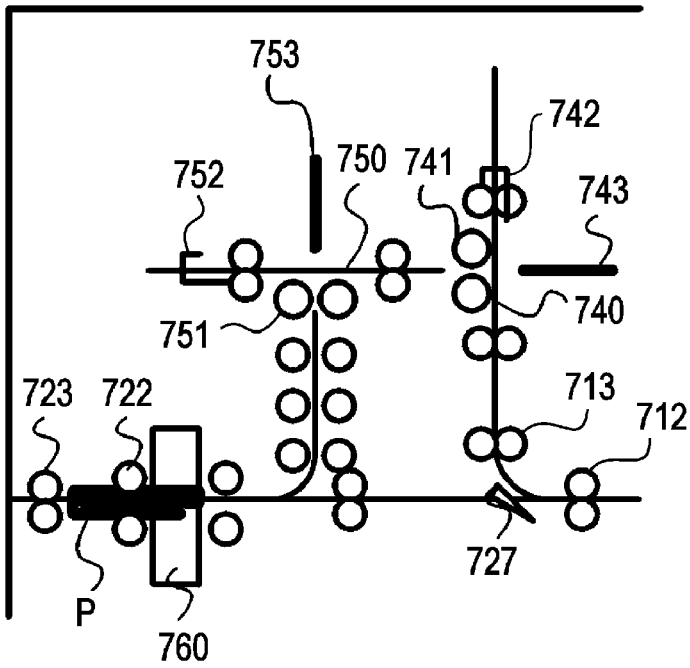
FIGS. 9A and 9B are partial sectional views which illustrate fold conveying.
Figure 9B:
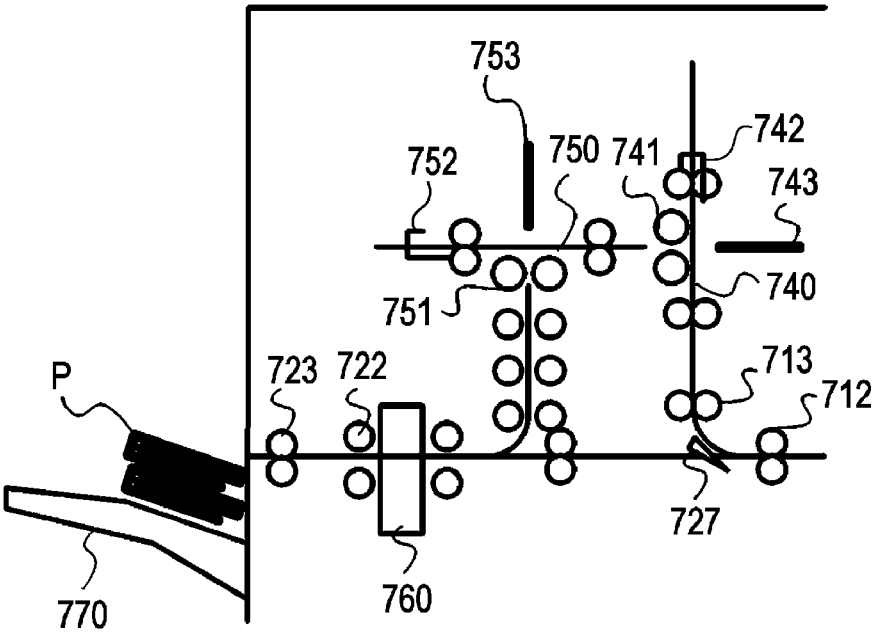

Meanwhile, when the letter-sealing process is performed, the letter-sealing process to prepare a simplified sealed letter by adhering a seal on the sheet P is performed by a sealer 760 which is arranged at the conveying path 733, as illustrated in FIG. 9A. Conditions for performing the letter-sealing process will be described later. The sheet P having the letter-sealing performed is discharged to the outside by the pairs of rollers 722, 723 and stacked on the stack tray 770 as illustrated in FIG. 9B.

Figure 11:
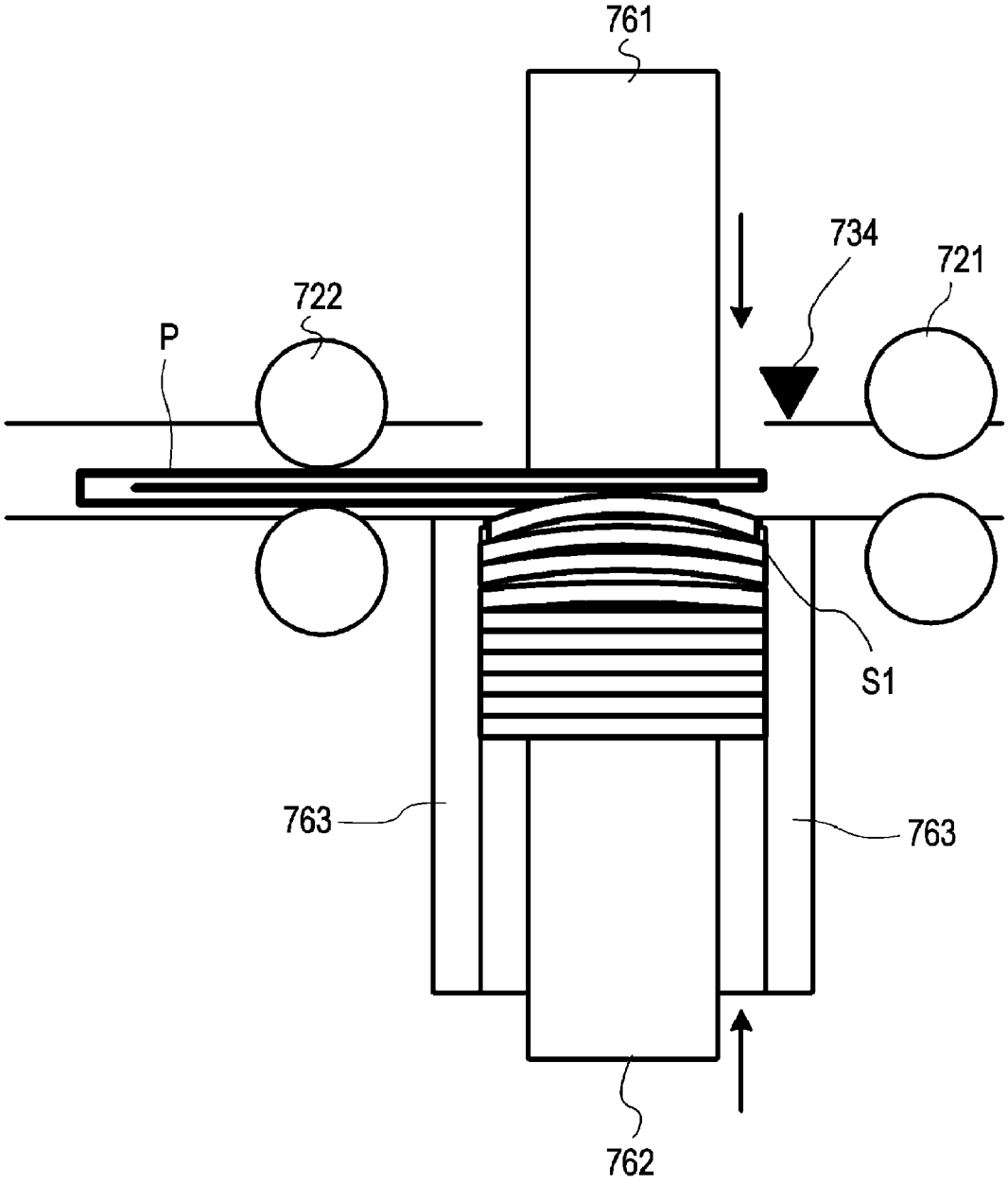
FIG. 11 is an explanatory view of seal adhering by the sealer.
Figure 12:
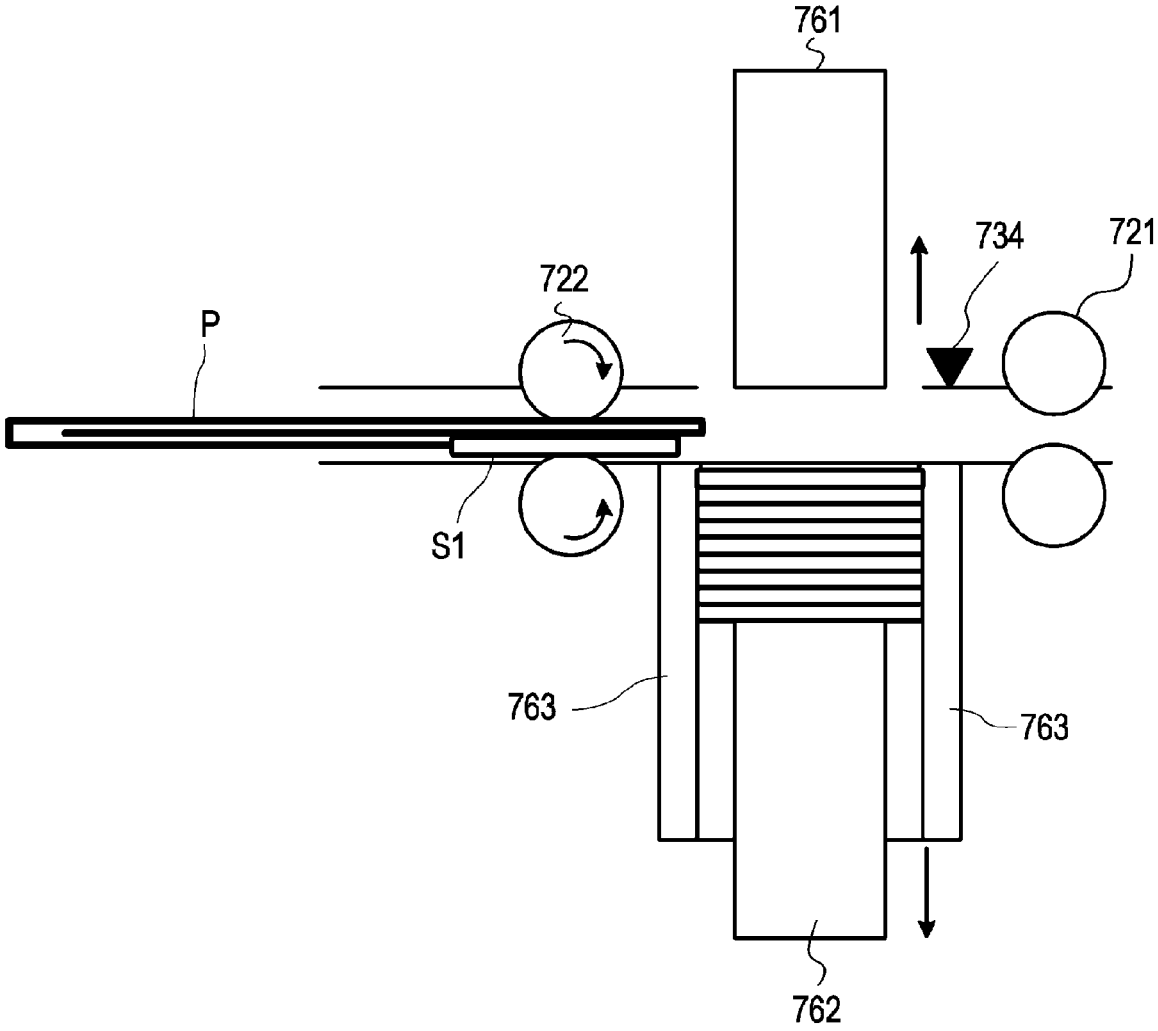
FIG. 12 is an explanatory view of seal adhering by the sealer.

Here, the sealer 760 will be described with reference to FIGS. 10 to 12. The sealer 760 is a sealing portion to seal a sheet bundle by adhering an end part of the inwardly twice-folded sheet at one end in the conveying direction to a surface of the sheet bundle with an adhesive member. The sealing portion in the present embodiment includes a plurality of sealers respectively having the adhesive member (the seal) of different length in the conveying direction. However, in FIGS. 10 to 12, the configuration having one sealer 760 as the sealing portion is described as an example. FIG. 10B illustrates the seal S to be adhered to the sheet in order to perform letter-sealing on the inwardly twice-folded sheet. One side of the seal S is an adhesive face and the other side of the adhesive face is a peeling face. The seals S are attached to the sealer 760 in a state of being vertically stacked as illustrated in FIG. 10A.

Figure 10A:
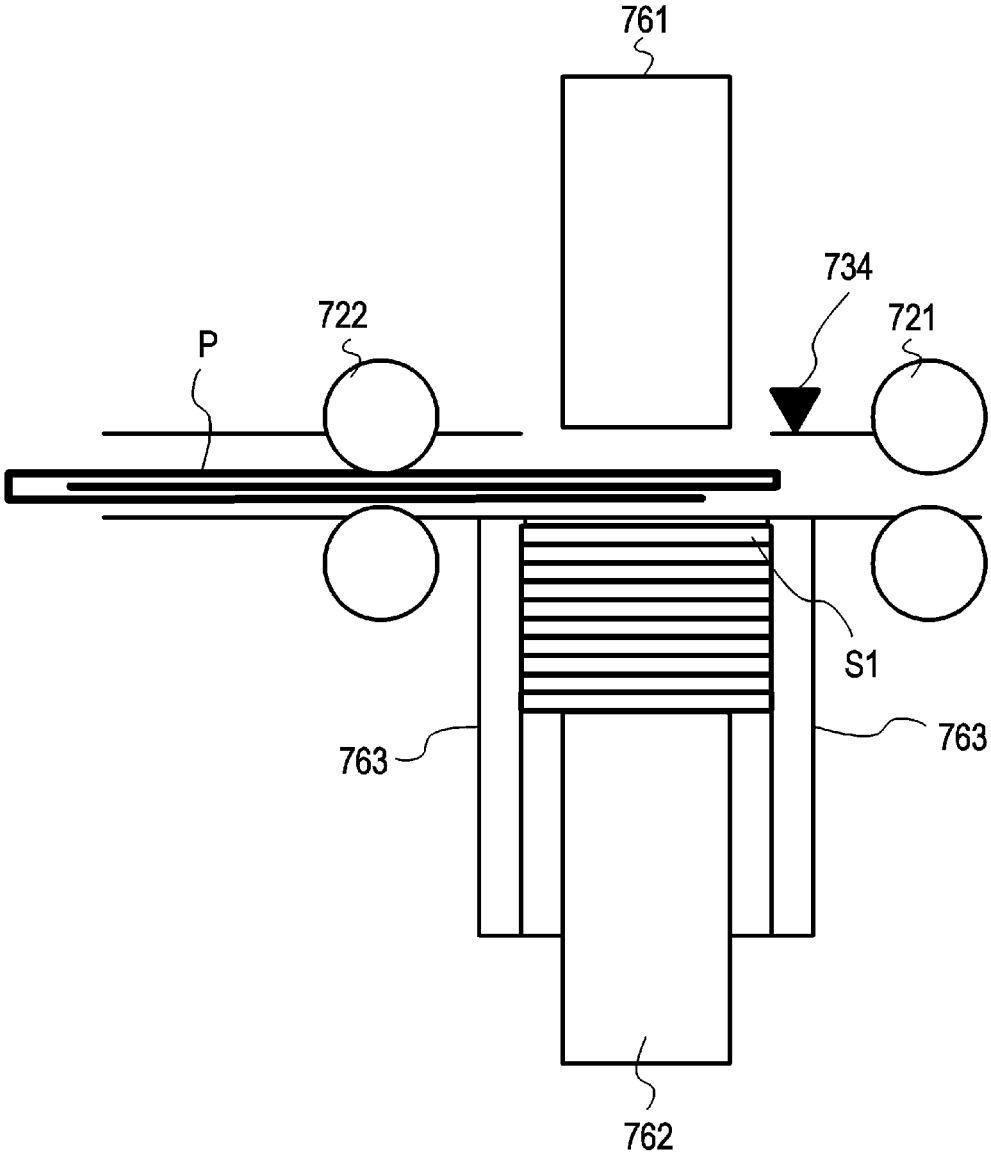
FIG. 10A is an explanatory view of seal adhering by a sealer and FIG. 10B is a perspective view of seals.
Figure 10B:
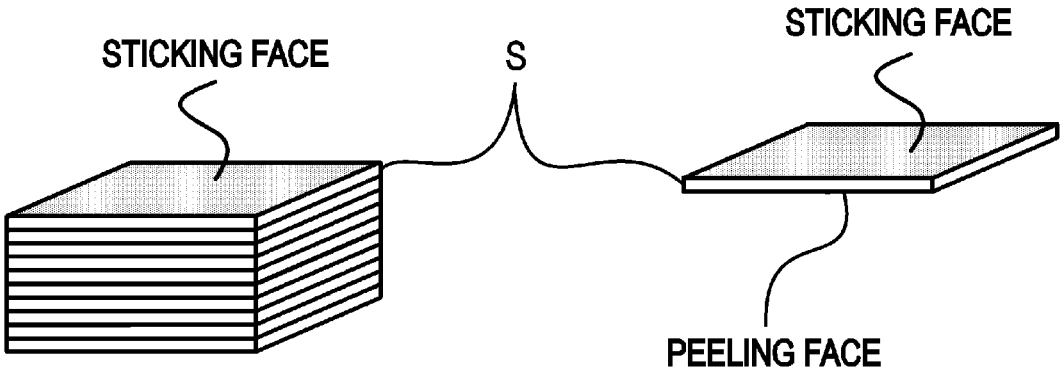

As illustrated in FIG. 10A, the inwardly twice-folded sheet P is fed to the position of the sealer 760 and is once stopped by the pairs of rollers 721, 722 having an input of a conveying path sensor 734 as a reference. At that time, the twice-folded sheet P is stopped at the position where the folded end part (the one end part in the conveying direction) of the sheet P to be adhered is opposed to the seal of the sealer 760, as illustrated in FIG. 10A. After the sheet P is stopped, a seal pressing plate 762 is lifted by a motor (not illustrated) and a seal pressing plate 761 is similarly lowered by a motor (not illustrated) so that the sheet P is nipped. The seal S1 at the top face of a seal bundle which is pushed up by the seal pressing plate 762 is caught by a projection at the top end of a seal accommodating unit 763 and is adhered to the sheet P in a state of being deformed as illustrated in FIG. 11. After the center portion of the seal S1 is adhered to the sheet P by the seal pressing plates 761, 762, only the seal S1 is discharged from the seal accommodating unit 763 when the seal pressing plates 761, 762 are respectively returned to the initial position. Then, when conveying of the sheet P is restarted by the pairs of rollers 721, 722, the sheet P is conveyed in the state of being letter-sealed having the seal S1 adhered, as illustrated in FIG. 12. The sheet P having the letter-sealing performed is discharged to the outside by the pairs of rollers 722, 723 and stacked to the stack tray 770.

The sheets discharged by the pair of discharge rollers 723 are sequentially stacked to the stack tray 770. The stack tray 770 is vertically moved by a motor (not illustrated) while the top face position is detected by a sensor (not illustrated) so that the top face is continuously kept constant.

(Sheet Flow in Sheet Processing Apparatus)

Next, sheet flow in the letter-sealing apparatus 700 and the finisher 500 will be described along the letter-sealing mode.

(Sheet Flow in Letter-Sealing Mode)

Figure 15A:
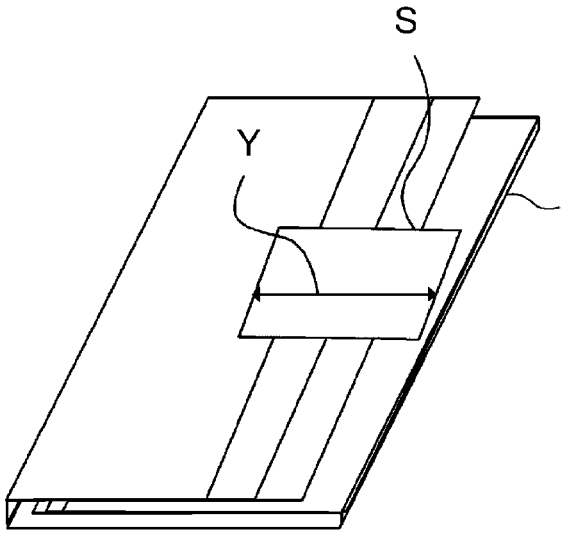
FIGS. 15A and 15B are explanatory views of a displacing-processed sheet bundle and FIG. 15C is an explanatory view of inwardly twice-folding positions of the displacing-processed sheet bundle.
Figure 15B:
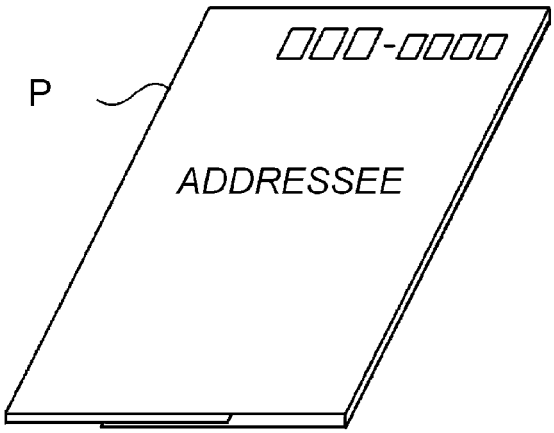

The sheet flow in the letter-sealing mode will be described with reference to FIGS. 16 and 17. In the letter-sealing mode, the letter-sealing apparatus 700 performs the process to prepare a simplified sealed letter by sealing a sheet end part with a seal as illustrated in FIG. 15A after performing inwardly twice-folding against the sheet.

As described above, the letter-sealing apparatus 700 has the sealer (the sealing portion) 760 to seal the sheet by adhering the end part of the inwardly twice-folded sheet at the one end in the conveying direction with the seal (the adhesive member) S. The sealer 760 includes the plurality of sealers respectively having the seals S of different length in the conveying direction. Here, as an example, FIGS. 16 and 17 illustrate the configuration that three sealers 760*a*, 760*b*, 760*c* respectively accommodating the seals S of different length in the conveying direction are arranged on the conveying path within the letter-sealing apparatus 700. Then, the letter-sealing process to seal the sheet bundle having sheet end parts displaced in the conveying direction as described above is performed by utilizing any of the sealers 760*a*, 760*b*, 760*c*.

Here, the configuration of arranging respective sealers 760 lined up on the conveying path (in the conveying direction) is described as an example. However, the present invention is not limited to the above. For example, respective sealers may be arranged movably in the direction intersecting with the sheet conveying direction and one of the sealers may be moved onto the conveying path.

Figure 18B:
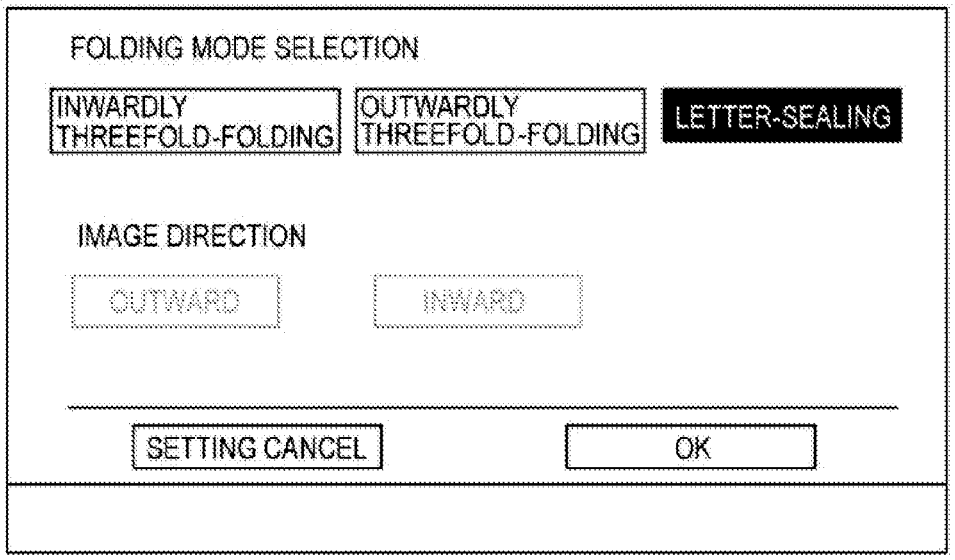

The letter-sealing mode is set by a user with the operational display portion 420 of the image forming apparatus main body 10. First, the key "Finishing" illustrated in FIG. 3A is depressed. Accordingly, the process mode selection screen is displayed as illustrated in FIG. 18A. Then, when a key "Folding" is depressed in the screen of FIG. 18A, a folding mode selection screen is displayed as illustrated in FIG. 18B. By depressing a key "Letter-sealing" in the screen of FIG. 18B, the letter-sealing mode is set.

Figure 15C:
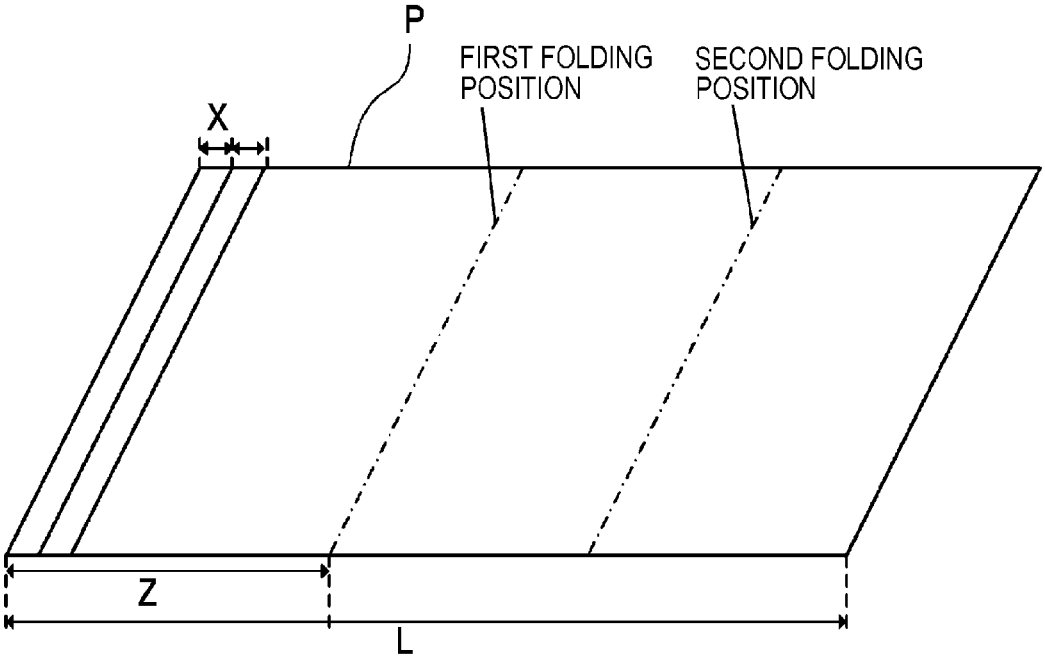

First, the sheet discharged from the image forming apparatus main body 10 is conveyed to the inside of the finisher by the pair of inlet rollers 502 in the finisher 500. Then, the sheets of the number for each bundle are wound around the buffer roller 505. At that time, by changing the sheet stop position on the buffer path 523, the sheet bundle having sheet end parts displaced in the conveying direction (the displacing-processed sheet bundle) is prepared. Here, as illustrated in FIG. 15C, the sheet bundle having sheet end parts displaced in the conveying direction respectively by the predetermined amount is described as an example. The sheet bundle displacing-processed as described above is peeled from the buffer roller 505 and guided to the conveying path 522 by the switching member 510, and then, is conveyed to the letter-sealing apparatus 700 by the pairs of rollers 506 to 509.

The letter-sealing apparatus 700 performs the process that the sheet bundle displacing-processed as described above is inwardly twice-folded so that one end part is respectively exposed while the one end part covers the other end part and is sealed with the seal having length longer than the exposed length of the end parts of the one end. First, the sealer accommodating the seals having length longer than the length based on the number of sheets and the sheet displaced amount of the sheet bundle (longer than the above-mentioned exposed length) is to be selected. Specifically, the required seal length Y is calculated as $Y=X(N+1)$ while N denotes the number of sheets for each sheet bundle and X denotes the sheet displaced amount. Then, the sealer accommodating the seals having length equal to or longer than the calculated length Y is selected from among the sealers 760*a*, 760*b*, 760*c*. In this manner, the seal to adhere the end parts of all sheets including the sheet bundle is obtained. The sealer selection (the seal selection) will be described later in detail with reference to FIG. 19 and FIG. 22A.

Figure 16:
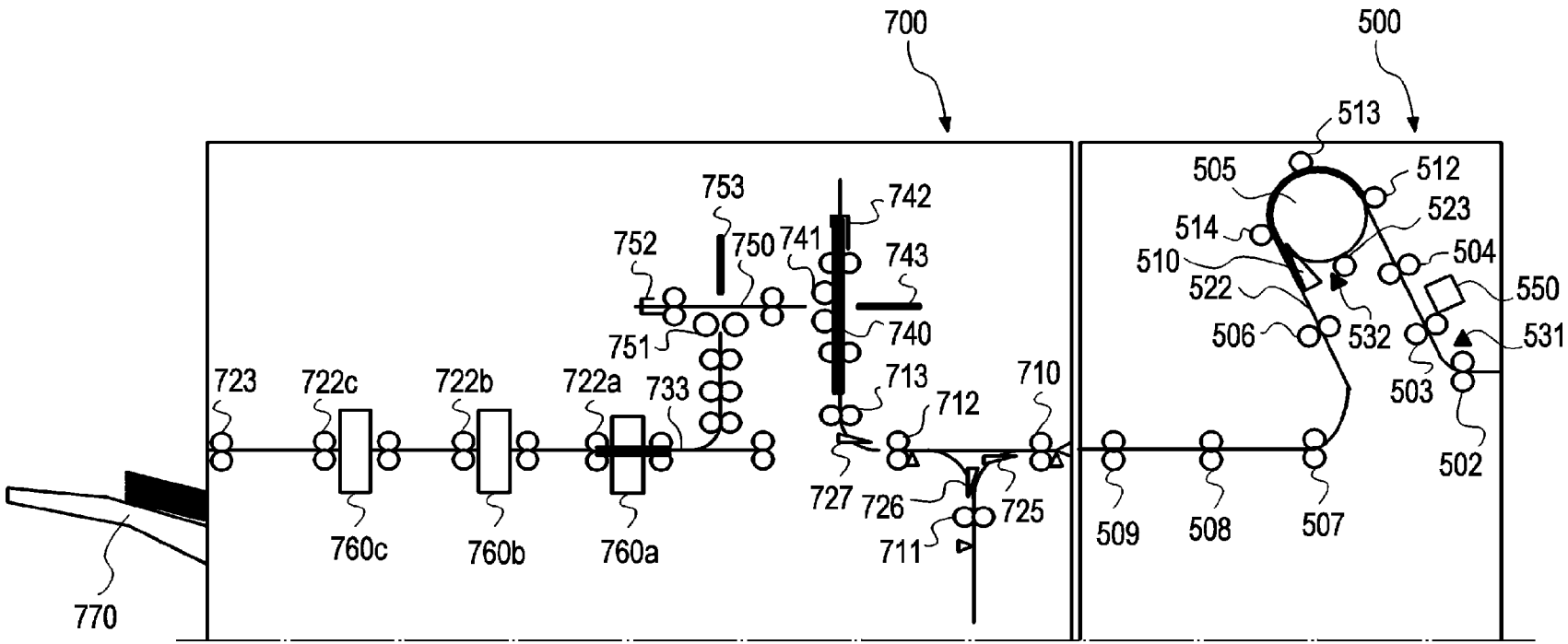
FIG. 16 is a sectional view which illustrates sheet flow at the time of inwardly twice-folding of the sheet processing apparatus.

The sheet bundle P conveyed to the letter-sealing apparatus 700 is guided to the fold conveying path 740 in FIG. 16 in order to be inwardly twice-folded in the state that the sheets are displaced respectively by the predetermined amount. The top end restricting plate 742 is kept waiting at the position of length Z from the fold center (the position of the pushing plate 743) to the upper side in FIG. 16. The length Z from the fold center is acquired as $Z=L/3+X\cdot N/3$. Here, L denotes length in the conveying direction of a sheet to be letter-sealed, X denotes the displaced amount of the sheet and N denotes the number of sheets for each sheet bundle. The sheet bundle P guided to the fold conveying path 740 is conveyed until the top end thereof hits the top end restricting plate 742. The sheet bundle P is fed to the folding roller 741 by the pushing plate 743 after hitting the top end restricting plate 742, and then, the first folding process is performed (at the first folding position in FIG. 15C).

Figure 17:
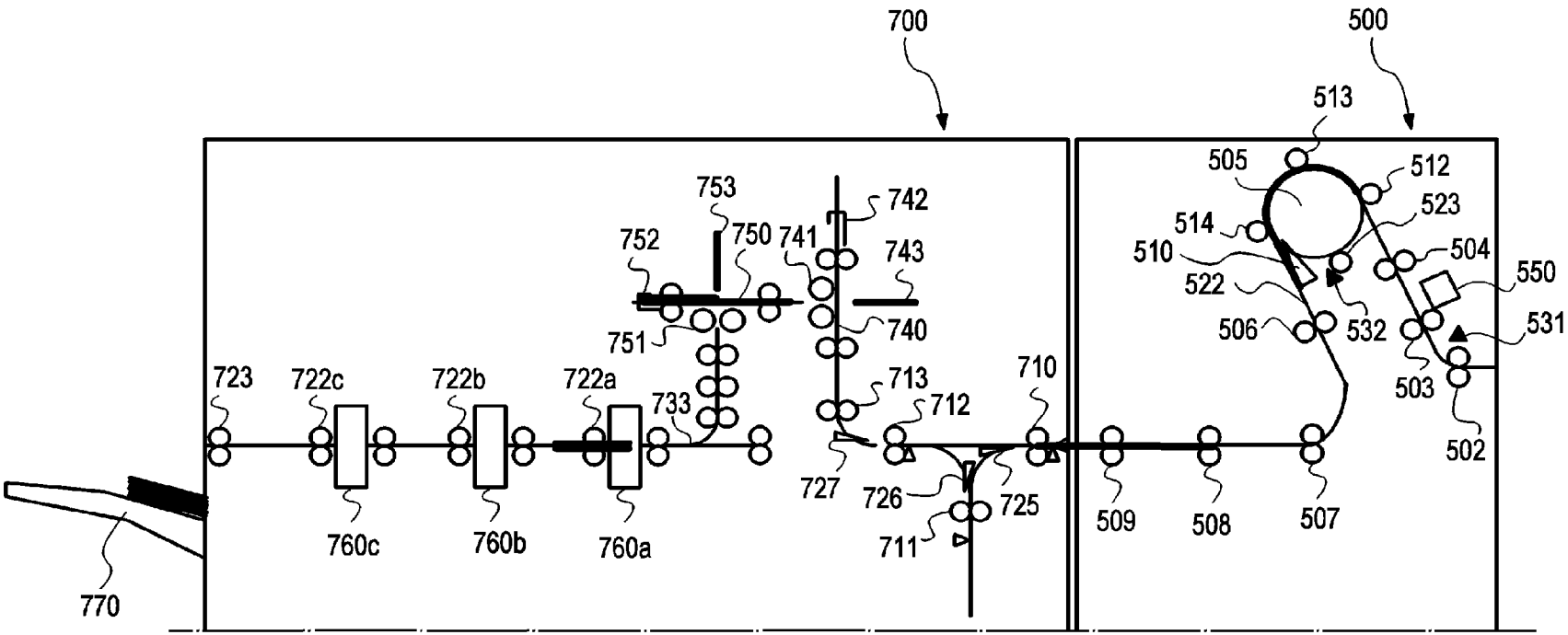
FIG. 17 is a sectional view which illustrates sheet flow at the time of inwardly twice-folding of the sheet processing apparatus.

The sheet bundle P having the first folding process performed is guided to the fold conveying path 750 in FIG. 17. The top end restricting plate 752 is kept waiting at the position of the length Z from the fold center (the position of pushing plate 753) to the left side in FIG. 17. The length Z from the fold center is acquired as $Z=L/3+X\cdot N/3$. The sheet bundle P guided to the fold conveying path 750 is conveying until the top end thereof hits the top end restricting plate 752. The sheet bundle P is fed to the folding roller 751 by the pushing plate 753 after hitting the top end restricting plate 752, and then, the second folding process is performed (at the second folding position in FIG. 15C).

Then, the sheet bundle P having the second folding process performed is fed to the conveying path 733 where the sealer 760 is arranged in the state of being inwardly twice-folded so that one end part in the conveying direction covers the other end part. At that time, one end part of each sheet forming the sheet bundle P is displaced so as to be respectively exposed. That is, the sheet bundle having the displacing process performed as described above is to be in the state of being inwardly twice-folded so that the one end part of each of the plurality of sheets is respectively exposed while the one end part in the conveying direction covers the other end part.

The sheet bundle P fed to the conveying path 733 where the sealer 760 is arranged is sealed by adhering the seal to all of the exposed sheet end parts and a surface of the sheet bundle with the selected sealer among the plurality of sealers. In the selected sealer 760, when the conveying path sensor 734 (see FIG. 10A) becomes OFF, the sheet bundle P is stopped and the seal S is adhered. In this manner, the product (the sheet bundle P in FIG. 15A) having the seal adhered to all of the sheets can be prepared. The unselected sealer 760 simply conveys the sheet bundle P to downstream. Then, the sheet bundle P is sequentially stacked to the stack tray 770.

FIG. 15A illustrates the product prepared in the letter-sealing mode. The seal S is adhered to the end part of the inwardly twice-folded sheet by the sealer 760 and the sheet is letter-sealed. For example, a user can post and mail the letter-sealed sheet as a postal matter by printing a postal code, an address and an addressee on the front face of the letter-sealed sheet preliminarily and printing an addresser on the back face (the face where the seal is to be adhered) preliminarily.

Figure 19:
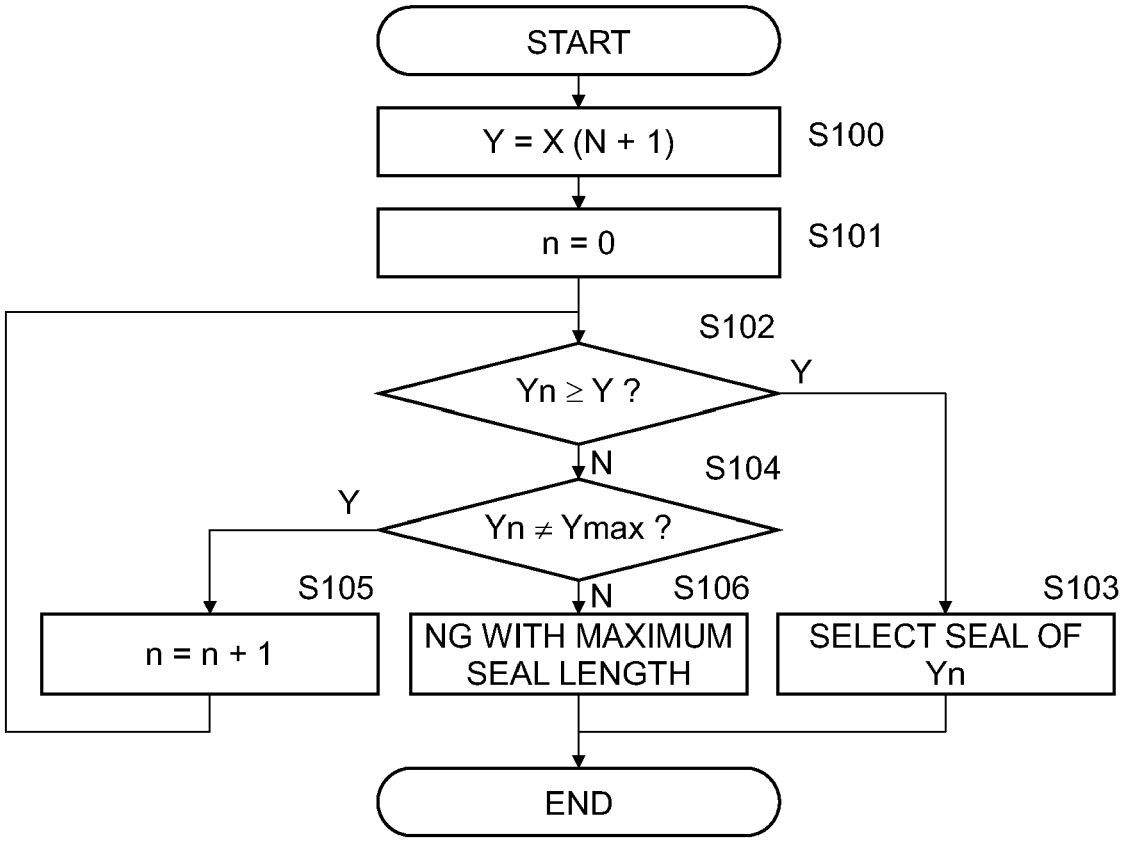
FIG. 19 is a flowchart which illustrates flow of a seal selection process.

Next, the sealer selection (the seal selection) to adhere all of the exposed sheet end parts and the surface of the sheet bundle will be described in detail with reference to FIG. 19 and FIG. 22A. The sealer accommodating seals of length longer than the exposed length of the sheet end part is selected from among the plurality of sealers respectively accommodating seals of different length in the conveying direction. FIG. 19 is a flowchart describing the flow of selecting the seal of appropriate length based on the number of sheets including the sheet bundle and the sheet displaced amount. FIG. 22A is a table exemplifying seal length of seals of different length set within the apparatus.

In the letter-sealing apparatus 700, three kinds of seals having respectively different seal length Yn in the conveying direction are set at the sealers. FIG. 22A exemplifies the length of the respective seals (hereinafter, called the seal length) from the minimum seal length Y0 to the maximum seal length Y2.

As illustrated in FIG. 19, first, when the letter-sealing mode is set, the seal length Y which is required (hereinafter, called the necessary seal length Y) is acquired in step S100. As described above, the necessary seal length Y is acquired as Y=X(N+1) while N denotes the number of sheets for each sheet bundle and X denotes the sheet displaced amount.

Next, a count value n is initialized in step S101. Then, in step S102, the necessary seal length Y calculated as described above is compared to the seal length Yn corresponding to the count value n in FIG. 22A. Since the count value n is initialized to zero, the seal length Y0 is a comparison target of the necessary seal length Y at first. When the seal length Yn to be compared is equal to or longer than the necessary seal length Y, it is determined that the seal length to adhere all of the sheet end parts of the sheet bundle is satisfied and the process proceeds to step S103. Then, the seal of the seal length Yn is selected in step S103 and the selection process ends. On the other hand, when the seal length Yn to be compared is shorter than the necessary seal length Y, the process proceeds to step S104. In step S104, it is determined whether or not comparison with the maximum seal length Ymax set in the apparatus (Y2 in FIG. 22A) is completed. When the seal length Yn is not Ymax in step S104, the process proceeds to step S105 and the count value n is incremented by one. Then, returning to step S102, the comparison between the seal length Yn corresponding to the count value n and the necessary seal length Y is repeated. On the other hand, when seal length Yn is Ymax in step S104, it is determined that necessary seal length Y is not satisfied after comparison with all of the set seal length, and then, the selection process ends as "NG".

Accordingly, a sheet bundle can be sealed by adhering a seal to all of the displaced sheet end parts and an inner sheet can be prevented from being fallen out without using a specially shaped seal. In addition, since the subsequent process is performed after the sheets of the sheet bundle are overlapped being displaced respectively by a predetermined amount, the seal can be evenly adhered to the respective displaced sheet end parts.

Figure 20:
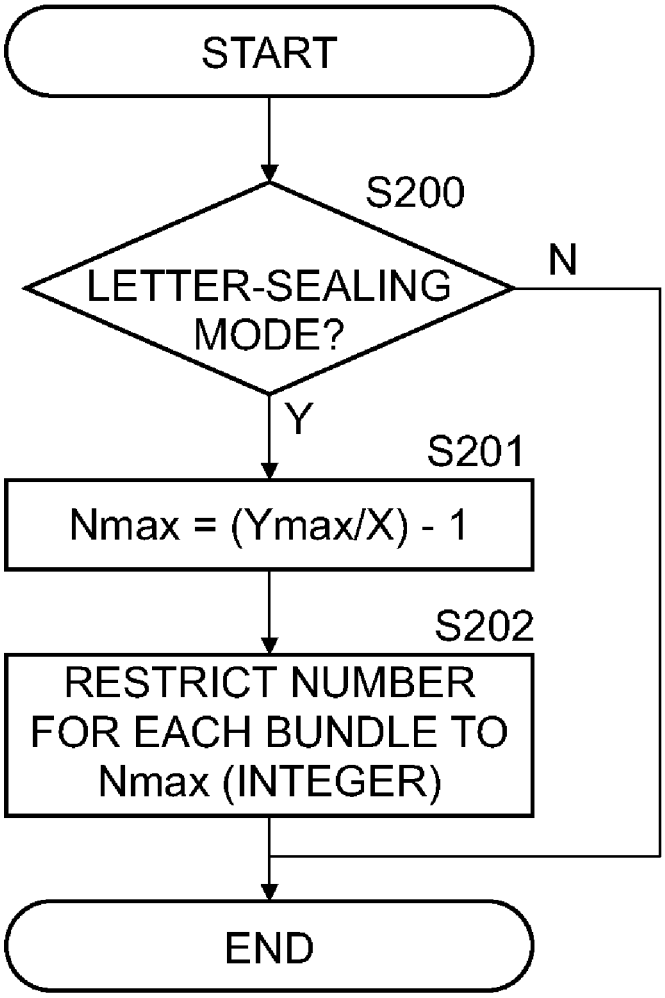
FIG. 20 is a flowchart which illustrates flow of sheet number restriction of a letter-sealing process corresponding to the maximum seal length.

Further, the maximum number of sheets for each bundle when the displacing-processed sheet bundle is sealed by the sealer is to be restricted based on the maximum seal length and the sheet displaced amount. Here, the number of sheets for each sheet bundle is set at the operational display unit 400 of the image forming apparatus main body 10. Specifically, when the number of sheets is set at the operational display unit 400 exceeding the processable maximum number of sheets per sheet bundle, the setting is not accepted and resetting is urged to be performed by a user. In the following, the description is performed with reference to FIG. 20. FIG. 20 is a flowchart describing the flow to restrict the number of sheets for each bundle of the letter-sealing process corresponding to the maximum seal length.

As illustrated in FIG. 20, when the letter-sealing mode is set in step S200, the maximum number for each sheet bundle in the letter-sealing mode is calculated in step S201. The maximum number Nmax for each bundle for possible letter-sealing process is acquired as Nmax=(Ymax/X)−1, while Ymax denotes the maximum seal length set within the apparatus and X denotes the displaced amount. Here, Nmax is to be an integer.

Then, with the acquired maximum number Nmax, the number of sheets for each bundle as setting to the letter-sealing mode is restricted to Nmax as an integer in step S202. In this manner, the case that the letter-sealing process cannot be performed can be avoided (the "NG" process in FIG. 19). In the case that the letter-sealing mode is not set in step S200, the process simply ends.

Figure 21:
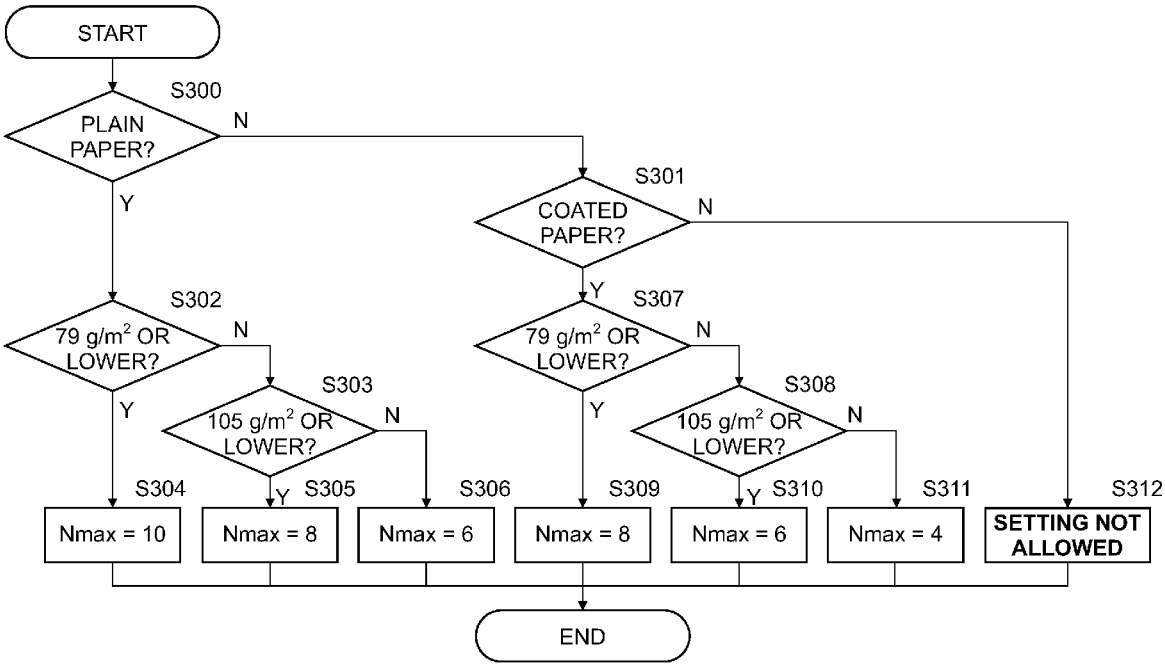
FIG. 21 is a flowchart which illustrates flow of sheet number restriction of the letter-sealing process corresponding to paper types.

Further, the number of sheets for each bundle when the displacing-processed sheet bundle is sealed by a sealer is restricted for each type of the sheet which is previously set and registered. Here, in addition to the maximum number of sheets for each sheet bundle, the type of the sheet is set at the operational display unit 400 of the image forming apparatus main body 10. In the following, the description is performed with reference to FIG. 21 and FIG. 22B. FIG. 21 is a flowchart describing the flow to restrict the number of sheets for each bundle in the letter-sealing process corresponding to the type of the sheet. FIG. 22B is a table to indicate the restricted number for the letter-sealing process corresponding to the types of the sheet.

Adhering strength of the seal varies due to elastic force at a crease and a height of a crease of the inwardly twice-folding and difference of surface characteristics of contacting faces in accordance with the types of the sheet (material, shape and grammage of a sheet). Accordingly, by restricting the maximum number for each bundle in setting the letter-sealing mode for each type of the sheet (hereinafter, also called the paper), the appropriate letter-sealing process can be performed despite of the types of the sheet.

As described with reference to FIG. 3B (the registration screen of paper type), the image forming apparatus main body 10 has the mode to register the paper type, so that the paper type to be set at the respective cassettes 114, 115 and the manual feeding portion 125 is registered by the operational display portion 420. With this configuration, grammage, material and shape of the sheet in each feeding portion 114, 115, 125 can be determined.

FIG. 22B exemplifies the restricted number in the letter-sealing process corresponding to the paper types. Allowable range of the number for the possible letter-sealing is defined in accordance with material, shape and grammage of the paper. Here, setting the letter-sealing is prohibited depending on a paper type.

When the number restricting process for the letter-sealing process corresponding to a paper type is started, it is determined whether or not the paper is plain paper in step S300. When determined to be plain paper, condition determination corresponding to grammage is performed as proceeding to step S302 or step S303. Then, the maximum number for each bundle in the letter-sealing mode is set in accordance with the grammage of each plain paper in steps S304 to S306 and the process ends. On the other hand, when determined not to be plain paper in step S300, it is determined whether or not it is coated paper as proceeding to step S301. When determined to be coated paper, similar to the case of the plain paper, condition determination corresponding to grammage is performed as proceeding to step S307 or step S308. Then, the maximum number for each bundle in the letter-sealing mode is set in accordance with the grammage of each coated paper in steps S309 to S311 and the process ends. On the other hand, when determined not to be coated paper in step S301, it is determined that letter-sealing cannot be performed because of being paper types (here, transparency film or tab sheet) not to be plain paper nor coated paper as proceeding to step S312, so that the letter-sealing process is restricted.

In the abovementioned embodiment, the apparatus utilizing the seal (the adhesive member) cut into a predetermined size is exemplified as illustrated in FIG. 10B. However, the present invention is not limited to the above. For example, the apparatus may adhere a seal while cutting a long tape (the adhesive member) which has an adhesive face. Further, the apparatus may utilize tape-shaped label-seal-like material including peeling paper and a seal.

In the abovementioned embodiment, a copying machine is exemplified as the image forming apparatus main body. However, the present invention is not limited to the above. For example, the image forming apparatus main body may be a printer, a facsimile machine, or a multifunction machine having functions thereof combined. Further, the sheet processing apparatus is exemplified to be detachably attachable to the image forming apparatus main body. However, the present invention is not limited to the above. For example, the sheet processing apparatus may be integrally included into the image forming apparatus main body. By applying the present invention to such a sheet processing apparatus, similar effects can be obtained.

Furthermore, in the abovementioned embodiment, the combination of the finisher and the letter-sealing apparatus is exemplified as the sheet processing apparatus. However, the present invention is not limited to the above. As described above, provided being capable of performing the twice-folding process of a sheet bundle and the sealing process to adhere end parts of the sheet bundle with the adhesive member, the sheet processing apparatus may be configured integrally or separately. Alternatively, the sheet processing apparatus may be configured to combine other processing. By applying the present invention to such a sheet processing apparatus, similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-143284, filed Jun. 16, 2009, and No. 2010-117970, filed May 24, 2010, which are hereby incorporated by reference herein in their entirety.

What is claimed is:

1. A sheet processing apparatus comprising:

a conveying portion which conveys a sheet having one end part and another end part in a conveying direction;

an overlapping portion at which a plurality of the sheets are overlapped to form a sheet bundle while displacing the one end part of each conveyed sheet in the conveying direction;

a folding portion which folds the sheet bundle twice so that the one end parts of the plurality of sheets cover the other end parts of the plurality of sheets to expose the one end parts displaced respectively; and a sealing portion which seals the sheet bundle so that all of the one end parts, disposed in the conveying direction and exposed, of the plurality of sheets are adhered with an adhesive member.

2. The sheet processing apparatus according to claim 1, wherein a maximum number of sheets for each sheet bundle to be sealed by the sealing portion is restricted based on a length in the conveying direction of the adhesive member and a displaced amount of each sheet.

3. The sheet processing apparatus according to claim 1, wherein a maximum number of sheets for each sheet bundle to be sealed by the sealing portion is restricted corresponding to each type of sheet which is previously set and registered.

4. The sheet processing apparatus according to claim 1, wherein the overlapping portion includes a rotating member capable of having a plurality of conveyed sheets wound therearound and overlapped while being displaced in a rotating direction of the rotating member.

5. The sheet processing apparatus according to claim 1, wherein the sealing portion includes a plurality of adhesive members respectively having different lengths in the conveying direction.

6. An image forming system which includes an image forming portion to form an image on a sheet and a sheet processing apparatus to selectively perform a process against an image-formed sheet, the sheet processing apparatus comprising:

a conveying portion which conveys a sheet having one end part and another end part in a conveying direction;

an overlapping portion at which a plurality of the sheets are overlapped to form a sheet bundle while displacing the one end part of each conveyed sheet in the conveying direction;

a folding portion which folds the sheet bundle twice so that the one end parts of the plurality of sheets cover the other end parts of the plurality of sheets to expose the one end parts displaced respectively; and a sealing portion which seals the sheet bundle so that all of the one end parts, disposed in the conveying direction and exposed, of the plurality of sheets are adhered with an adhesive member.

7. The image forming system according to claim 6, wherein a maximum number of sheets for each sheet bundle to be sealed by the sealing portion is restricted based on length in the conveying direction of the adhesive member and a displaced amount of each sheet.

8. The image forming system according to claim 6, wherein a maximum number of sheets for each sheet bundle to be sealed by the sealing portion is restricted corresponding to each type of sheet which is previously set and registered.

9. The image forming system according to claim 6, wherein the overlapping portion includes a rotating member capable of having a plurality of conveyed sheets wound therearound and overlapped while being displaced in a rotating direction of the rotating member.

10. The image forming system according to claim 6, wherein the sealing portion includes a plurality of adhesive members respectively having different lengths in the conveying direction.

* * * * *